US012569035B1

(12) United States Patent
Lee

(10) Patent No.: US 12,569,035 B1
(45) **Date of Patent: *Mar. 10, 2026**

(54) ADHESIVE INSERT FOR SHOE SOLE CLEANING AND PROTECTION

(71) Applicant: Marcus Sun Lee, San Diego, CA (US)

(72) Inventor: Marcus Sun Lee, San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/267,328

(22) Filed: Jul. 11, 2025

Related U.S. Application Data

(60) Provisional application No. 63/755,770, filed on Feb. 7, 2025, provisional application No. 63/755,778, filed on Feb. 7, 2025.

(51) Int. Cl.

| | |
|---|---|
| ***A43B 3/16*** | (2022.01) |
| ***A43B 13/14*** | (2006.01) |
| ***A43B 13/36*** | (2006.01) |
| ***A43B 17/00*** | (2006.01) |
| ***A43B 17/18*** | (2006.01) |
| ***A43C 15/02*** | (2006.01) |

(52) U.S. Cl.
CPC ..... *A43B 17/003* (2013.01); *A43B 3/16* (2013.01); *A43B 17/18* (2013.01)

(58) Field of Classification Search
None
See application file for complete search history.

(56) References Cited

U.S. PATENT DOCUMENTS

| | | | | |
|---|---|---|---|---|
| 3,083,393 A | | 4/1963 | Nappi | |
| 3,733,721 A | * | 5/1973 | Clemens | A43B 13/187 36/32 R |
| 3,903,620 A | * | 9/1975 | Gillet | A43C 13/12 36/15 |
| 4,727,661 A | * | 3/1988 | Kuhn | A43B 17/00 36/43 |
| 5,319,867 A | | 6/1994 | Weber | |
| 5,553,399 A | | 9/1996 | Strong | |
| 6,055,748 A | | 5/2000 | Harrison | |
| 6,122,793 A | * | 9/2000 | Pao | A47L 13/20 36/7.1 R |
| 7,377,054 B2 | * | 5/2008 | Milner | A43B 17/18 36/15 |
| 7,559,159 B1 | * | 7/2009 | Lundberg | A43D 999/00 36/73 |

(Continued)

OTHER PUBLICATIONS

Application as filed Jul. 11, 2025; U.S. Appl. No. 19/267,319.

(Continued)

*Primary Examiner* — Jila M Mohandesi

(74) *Attorney, Agent, or Firm* — Veros Legal Solutions, LLP

(57) ABSTRACT

An adhesive insert associated with a portable shoe guard assembly is disclosed for protecting athletic footwear and restoring outsole traction. The assembly includes a flexible, treaded guard body configured to cover at least the forefoot of a shoe. A removable insert is secured to the guard body via mechanical fasteners and includes a pressure-sensitive adhesive on its exposed surface. The adhesive lifts dust and debris from tread grooves without leaving residue. The fasteners are configured to retain the insert against the guard body when the shoe is withdrawn, allowing traction to be restored.

17 Claims, 10 Drawing Sheets

(56) References Cited

U.S. PATENT DOCUMENTS

| | | | | |
|---|---|---|---|---|
| 7,744,513 | B2 * | 6/2010 | Castellano | A61F 5/0195 482/79 |
| 7,997,008 | B2 * | 8/2011 | Coomer | A43B 3/16 36/7.4 |
| 8,024,872 | B2 * | 9/2011 | Pettis | A43B 13/36 36/73 |
| 8,225,532 | B2 * | 7/2012 | Chen | A43B 17/02 36/15 |
| 9,289,019 | B2 | 3/2016 | Cross | |
| 10,299,532 | B2 | 5/2019 | Cherosky et al. | |
| 2003/0106240 | A1 | 6/2003 | Wang et al. | |
| 2004/0194351 | A1 | 10/2004 | Gallegos | |
| 2004/0261290 | A1 * | 12/2004 | Wilson | A43B 1/0045 36/11.5 |
| 2005/0022420 | A1 | 2/2005 | Thomas | |
| 2006/0005425 | A1 * | 1/2006 | Votolato | A43B 3/16 36/7.3 |
| 2006/0005426 | A1 * | 1/2006 | Votolato | A43B 13/16 36/7.3 |
| 2006/0112591 | A1 | 6/2006 | Lombardo | |
| 2007/0119723 | A1 | 5/2007 | Smith | |
| 2008/0178492 | A1 | 7/2008 | Coomer | |
| 2009/0235556 | A1 * | 9/2009 | Reid | A43B 3/163 36/7.1 R |
| 2010/0088928 | A1 | 4/2010 | Sarantakos et al. | |
| 2011/0185598 | A1 * | 8/2011 | Tsen | A43B 3/16 36/135 |
| 2012/0174289 | A1 | 7/2012 | Lopez | |
| 2013/0116726 | A1 | 5/2013 | Mor et al. | |
| 2014/0048214 | A1 | 2/2014 | Dhillon | |
| 2016/0073724 | A1 | 3/2016 | McMahan | |
| 2017/0164681 | A1 | 6/2017 | Frank | |
| 2018/0035723 | A1 | 2/2018 | Utecht | |
| 2018/0271206 | A1 | 9/2018 | Corbett | |
| 2018/0352906 | A1 | 12/2018 | Miller | |
| 2019/0142110 | A1 | 5/2019 | Cruz et al. | |
| 2021/0030111 | A1 * | 2/2021 | Klimberg | A43B 3/246 |
| 2021/0368909 | A1 | 12/2021 | Wick | |
| 2024/0268509 | A1 | 8/2024 | Siragusa | |

OTHER PUBLICATIONS

Application as filed Jul. 11, 2025; U.S. Appl. No. 19/267,326.

Non Final Office Action mailed Aug. 12, 2020, U.S. Appl. No. 19/267,319.

Non Final Office Action mailed Aug. 22, 2025, U.S. Appl. No. 19/267,326.

Non Final Office Action mailed Dec. 8, 2025, U.S. Appl. No. 19/320,092.

* cited by examiner

ADHESIVE INSERT FOR SHOE SOLE CLEANING AND PROTECTION

TECHNICAL FIELD

The present disclosure relates generally to footwear accessories and, more particularly, to devices and methods intended to preserve or restore traction on shoe outsoles while shielding the outsole from premature wear and contamination.

BACKGROUND

Traction is a critical performance attribute of modern athletic footwear. In sports such as basketball, volleyball, handball, racquetball, futsal, and indoor soccer, athletes rely on sudden starts, stops, and changes in direction. These maneuvers demand a frictional interface between the court surface and the shoe's outsole that is both predictable and sufficiently high to prevent slip-and-fall injuries. However, an outsole's soft rubber compounds, siping, herringbone grooves, and micro-texturing make the outsole vulnerable to fouling and wear. Over time, dust, dirt, and other particulate matter accumulate within the tread pattern. Even a thin film of debris can drastically lower the coefficient of friction, forcing athletes to compensate with altered biomechanics that elevate the risk of ankle sprains, knee injuries, and hamstring strains.

Existing approaches to preserving traction present numerous shortcomings. Sticky floor mats positioned at gym entrances provide a temporary cleaning action, but they are fixed in place and become ineffective after repeated use because their exposed adhesive surfaces saturate with debris. Moreover, sticky mats cannot remove material lodged in recessed tread elements unless the athlete deliberately scrapes the sole, and they do nothing to protect the outsole during the commute to and from the venue. Liquids such as traction-enhancing sprays or tackifying gels have to be carried in a separate container, applied courtside, and allowed to flash-off or cure; this introduces time delays, odor, chemical exposure, and potential overspray that can damage flooring or uniforms. Spray residues can also trap additional dust once dry, creating a cycle of diminishing returns. Mechanical brushing devices and handheld wire or nylon brushes risk damaging soft rubber compounds, accelerating the very wear they seek to mitigate.

One long-standing attempt to address particulate fouling is the floor-mounted adhesive mat disclosed in U.S. Pat. No. 3,083,393. The device employs a stack of peelable, pressure-sensitive sheets that sit active-side-up within a rigid frame; as each sheet becomes saturated with dirt, it is peeled away to reveal a fresh tacky layer beneath. While effective at fixed thresholds, the mat is immobile, generates significant consumable waste, and offers no protection against abrasive wear incurred during the athlete's journey through parking lots, sidewalks, and locker rooms. Its flat geometry also fails to reach the curved toe-spring region common in court shoes, leaving debris trapped in that area.

A markedly different strategy is presented in U.S. Pat. No. 9,289,019, which teaches a thin, durable sheet coated on one side with a skin-safe pressure-sensitive adhesive and on the opposite side with a traction-enhancing texture. Intended for direct application to human skin the underside of a bare foot, the covering supplies temporary protection against hot sand, rough pavement, or wet surfaces. Because the adhesive bonds to skin, the sheet is inherently single-use; once removed, it cannot be reapplied without loss of tack. The covering therefore does not lend itself to repeated cleaning cycles, provides no barrier against outsole abrasion, and lacks any mechanical retention feature that would allow an adhesive element to be swapped out while a more durable support structure is reused.

To avoid contaminating their court shoes on abrasive outdoor surfaces such as sidewalks, asphalt parking lots, locker-room tiles, many athletes resort to transporting a second pair of "walking shoes." This two-pair routine is inconvenient, increases the volume of gear that must be carried, and offers no safeguard for situations in which the athlete must unexpectedly leave the court area. Disposable overshoe booties fashioned from thin polyethylene attempt to solve the transit problem but tear easily, offer poor ground traction, create slip hazards, and generate plastic waste. Reusable galoshes or rain overshoes are bulky, require manual stretching over the shoe, and rarely fit snugly around high-top athletic shoe contours; their waterproof materials often trap sweat and moisture, fostering microbial growth and odor.

Another class of prior solutions involves outsole "wraps" or "skins" which are thin thermoplastic films that adhere directly to the sole to form a sacrificial wear layer. Although these films can be die-cut to match specific shoe models, installation is difficult to handle, burdensome and time-consuming. Bubbles or wrinkles compromise adhesion, and the films must be peeled off and discarded once damaged. Removal can leave adhesive residue that attracts even more dirt or chemically interacts with rubber compounds, altering durometer or color. Furthermore, film-based products do not provide any means to clean the sole; they merely form a barrier that is itself prone to contamination.

From a materials standpoint, the outsole is designed to balance grip, abrasion resistance, flexibility, and weight. Repetitive abrasion also rounds the leading edges of tread lugs, degrading their ability to interlock with court surfaces. Meanwhile, ground-facing textures on any protective accessory must themselves avoid becoming slippery; a flat overshoe bottom with insufficient tread can cause the athlete to skid when walking to the venue, especially on wet pavement or dusty concrete.

Size variability further complicates matters. Athletic shoes differ in length, width, arch height, toe-spring angle, and outsole curvature. A one-piece protective cover may have to stretch or otherwise conform to this diversity without creating pressure points or hindering natural foot flexion. If the cover is too loose, it may shift laterally, exposing portions of the outsole or presenting a tripping hazard. If too tight, it can deform the shoe's cushioning midsole or restrict blood flow to the foot.

Environmental and sustainability considerations have come to the forefront as well. Single-use sticky sheets and disposable plastic overshoes contribute to landfill volume. Solvent-based tack sprays emit volatile organic compounds (VOCs) and may not comply with increasingly stringent regulations. Consumers and facility operators therefore seek reusable, washable, or biodegradable alternatives. However, reusable adhesives tend to attract biofilms and must withstand cleaning with mild detergents or alcohol without losing tack. Incorporating antimicrobial agents can inhibit bacterial and fungal colonization, yet such additives must be compatible with the adhesive chemistry and meet safety standards for skin contact.

Safety on non-court surfaces remains a pressing problem. Protective devices with smooth bottom faces may become dangerously slick on polished concrete or wet asphalt. Conversely, aggressive tread patterns can track mud and grit onto the court. Designers have to strike a balance by selecting ground-contact textures that grip outdoor surfaces yet shed debris before entering the gym. Inadequate consideration of this factor in previous solutions exposes athletes to slips and contaminates playing surfaces.

In summary, the prior art fails to provide a single, portable product that simultaneously protects the outsole from abrasive damage during transit, removes dust and debris from intricate tread patterns without leaving residue, maintains adequate ground traction on varied non-court surfaces, fits a broad range of athletic shoe geometries without discomfort, balances adhesive peel force with mechanical retention to avoid delamination, incorporates hygienic features such as antimicrobial treatments and ventilation, withstands washing or cleaning without performance loss, employs durable yet lightweight materials, offers customization and sustainability options, and remains cost-effective for everyday athletes. Addressing these interrelated challenges is crucial to enhancing player safety, preserving footwear investment, and reducing the environmental footprint associated with traction-maintenance products.

Accordingly, there remains a need for a portable, and effective outsole protection and traction enhancement system that overcomes the limitations of existing solutions by combining mechanical retention, case of cleaning, environmental sustainability, and compatibility with a wide range of athletic footwear geometrics.

SUMMARY

In light of the disadvantages mentioned in the previous section, the following summary is provided to facilitate an understanding of some of the innovative features unique to the present disclosure and is not intended to be a full description. A full appreciation of the various aspects of the disclosed embodiments can be gained by taking the entire specification and drawings as a whole.

The present disclosure provides a portable shoe-guard assembly that both protects an athletic shoe's outsole during transit and actively restores traction immediately before play. The assembly includes a flexible, wear-resistant guard body that is sized to cover at least a forefoot portion and in some embodiments, the entire outsole of a shoe. A ground-facing bottom surface of the guard body may carry a textured tread for safe walking on concrete, while a shoe-facing top surface carries one or more guard-body fasteners (e.g., hook-and-loop, Velcro, snaps, magnets, or rails). A removable insert mates with these fasteners via complementary insert fasteners; the insert's opposite face bears a pressure-sensitive adhesive formulated to remove dust and dirt from the shoe sole without leaving residue. The adhesive may be silicone-based, acrylic, natural-rubber, or other tacky polymers, and can be shielded by a peel-off protective film until use.

In some embodiments, the adhesive composition comprises a blend of tackifiers and plasticizers, wherein the tackifiers serve to enhance the initial adhesive strength and the plasticizers impart increased flexibility to the adhesive. In certain embodiments, the adhesive is formulated as a high-tack acrylic adhesive, providing a strong initial adhesion and demonstrating durable long-term performance under various environmental conditions. In other embodiments, the adhesive includes polyvinyl acetate (PVA), a thermoplastic polymer characterized by its adhesive properties, wherein the PVA component contributes to the overall bonding strength of the adhesive. In additional embodiments, the adhesive incorporates methacrylate, a monomer capable of forming robust chemical bonds upon exposure to moisture, thereby improving the adhesive's bond strength and resistance to environmental degradation.

The insert substrate may be formed from EVA, PU, neoprene, memory foam, cork, gel, or biodegradable materials, and may incorporate antimicrobial additives.

A hierarchy of forces is engineered so that the mechanical engagement between guard body and insert exceeds the peel strength of the adhesive against the shoe, ensuring the insert stays in place when the shoe is removed. Optional features include ventilation apertures through the guard body and/or insert; an upstanding perimeter wall or ridge that laterally retains the insert; adjustable straps or heel bands that secure the guard to a variety of shoe outsole contours; curved insert profiles that conform to upward-angled toe springs; and reflective or padded strap sections for comfort and safety. In some embodiments, both guard body and insert may be lightweight and washable, and individual inserts can be swapped out as the adhesive becomes saturated or when different tack levels are desired for varying court conditions. Collectively, these features deliver a single product that cleans, protects, ventilates, and grips, addressing all shortcomings identified in the prior art.

In one embodiment, a shoe guard comprises a guard body configured to cover at least a portion of the shoe sole that is configured to contact a ground surface, the guard body comprising a bottom surface and a top surface, wherein the top surface of the guard body includes at least one guard body fastener. An insert is removably attachable to the guard body, the insert having an insert top surface and an insert bottom surface, wherein the insert bottom surface comprises at least one insert fastener configured for engagement with the at least one guard body fastener to secure the insert to the guard body, and wherein the insert top surface comprises an adhesive for removably adhering to the shoe sole. In some embodiments, the shoe guard may comprise a removable protective film positioned to cover the adhesive. In some embodiments, the guard body is made of a durable, wear-resistant material. The material may be flexible to be adaptable to at least two different shoe sizes. In some embodiments, the guard body is configured to cover the entire outsole of the shoe. In some embodiments, the guard body is configured to cover at least a forefoot portion of the shoe outsole. In some embodiments, the guard body is configured to cover at least a heel portion of the shoe. In some embodiments, the bottom surface of the guard body comprises a textured surface for enhanced grip on the ground surface. In some embodiments, the guard body defines ventilation holes therethrough. In some embodiments, the adhesive is water-resistant. In some embodiments, the adhesive comprises a pressure-sensitive adhesive that does not leave residue on the shoe sole. In some embodiments, the adhesive comprises a silicone-based adhesive. In some embodiments, the insert comprises a substrate made of a material selected from the group consisting of ethylene-vinyl acetate (EVA) foam, polyurethane (PU) foam, latex foam, neoprene, memory foam, gel-based materials, and cork. In some embodiments, the at least one guard body fastener and the at least one insert fastener comprise corresponding hook-and-loop fasteners. In some embodiments, the top surface of the guard body defines at least one recess dimensioned to hold the at least one guard body fastener, such that the insert is substantially flush with the top surface of the guard body when attached. In some embodiments, a fastening force between the at least one guard body fastener and the at least one insert fastener is greater than an adhesive force between the adhesive on the insert top surface and the shoe sole. In some embodiments, the guard body further comprises at least one strap structured to extend over a portion of the shoe, thereby securing the shoe guard to the shoe. In some embodiments, the insert has a curved profile on its top surface matching a contour of the shoe outsole. In some embodiments, the guard body further comprises a perimeter wall extending upwards from the top surface of the guard body. In some embodiments, the insert is reusable and washable.

In another embodiment, a method for treating a sole of a shoe is provided. The method may use a shoe guard assembly, the assembly comprising a guard body having a top surface with at least one guard body fastener, and an insert removably attached to the guard body via at least one insert fastener on an insert bottom surface, the insert having an adhesive on an insert top surface. In these embodiments, the method may comprise positioning the shoe such that the sole contacts the adhesive on the insert top surface while the insert is attached to the guard body, and removing the shoe from the shoe guard assembly, wherein the insert remains attached to the guard body due to a fastening force between the at least one guard body fastener and the at least one insert fastener being greater than an adhesive force between the adhesive and the shoe sole, thereby removing dust and dirt from the shoe sole onto the adhesive. In some embodiments, the method may further comprise walking with the shoe guard assembly secured to the shoe prior to the step of removing the shoe from the shoe guard assembly, thereby protecting the shoe sole with the guard body. In some embodiments, the adhesive comprises a pressure-sensitive adhesive that does not leave residue on the shoe sole. In some embodiments, the insert includes a pull tab or grip feature that facilitates removal of the insert from the guard body. In some embodiments, the insert comprises a curved top surface configured to match a toe spring contour of the shoe sole. In some embodiments, the guard body includes a perimeter wall extending upwards from the top surface of the guard body. In some embodiments, the insert comprises a substrate made of a washable material selected from the group consisting of EVA foam, PU foam, neoprene, and memory foam. In some embodiments, the adhesive is zoned into regions of differing tack levels, and the method further comprises aligning the shoe such that a forefoot region of the sole contacts a higher-tack zone of the adhesive. In some embodiments, the insert includes a visual indicator configured to signal when the adhesive surface is saturated with debris. In some embodiments, the method comprises replacing the insert with a new insert after a predetermined number of uses. In some embodiments, the insert is secured to the guard body using a hook-and-loop fastening system. In some embodiments, the guard body includes a bottom surface with a tread pattern for traction on ground surfaces. In some embodiments, the method comprises storing the shoe guard assembly in a travel case after use. In some embodiments wherein the insert is reusable, the method may further comprise detaching the insert from the guard body after removing the shoe and cleaning the reusable adhesive on the insert top surface.

In another embodiment, an insert for use in a shoe guard assembly comprises a substrate having a top surface and a bottom surface and an adhesive layer disposed on the top surface of the substrate, the adhesive layer being configured to removably adhere to a shoe sole and capture dust and debris therefrom. At least one insert fastener is disposed on the bottom surface of the substrate, the insert fastener being structured to engage with a corresponding guard body fastener of the shoe guard assembly. A removable protective film may be positioned over the adhesive layer to preserve tackiness prior to use. In some embodiments, the adhesive layer comprises a pressure-sensitive adhesive that does not leave residue on the shoe sole. In some embodiments, the adhesive layer comprises a silicone-based adhesive. In some embodiments, the adhesive layer is water-resistant and retains tack after exposure to moisture. In some embodiments, the adhesive layer is reusable and configured to regain tackiness after cleaning. In some embodiments, the substrate is made from a material selected from the group consisting of ethylene-vinyl acetate (EVA) foam, polyurethane (PU) foam, latex foam, neoprene, memory foam, gel-based materials, and cork. In some embodiments, the substrate includes antimicrobial additives. In some embodiments, the adhesive layer has a peel strength ranging from approximately 200 gram-force (gf) to 1000 gf. In some embodiments, the insert fastener comprises a hook or loop field configured for engagement with a complementary loop or hook field on the guard body. In some embodiments, the insert fastening engagement element has a shear strength ranging from approximately 1000 gf to 10000 gf. In some embodiments, the protective film includes a pull tab to facilitate removal without contacting the adhesive surface. In some embodiments, the adhesive layer is zoned into regions of differing tack levels to target specific areas of the shoe sole. In some embodiments, the substrate includes a curved profile along its top surface to conform to a toe spring region of the shoe sole. In some embodiments, the insert fastening engagement element covers between 20% and 80% of the bottom surface of the substrate. In some embodiments, the insert is configured to be seated within a recessed cavity of the guard body such that the adhesive layer is flush with or slightly below the top surface of the guard body. In some embodiments, the insert is reusable and washable.

In further embodiments, a method for manufacturing a customized shoe guard adapted to fit a specific shoe sole is also provided. This method comprises scanning a shoe sole to capture dimensional and contour data and generating a three-dimensional digital model of the shoe sole based on the scanned data and fabricating a customized elastomeric piece based on the digital model, the elastomeric piece being shaped to conform to the contours of the shoe sole. In some embodiments, the method may continue wherein a user provides a guard body piece having a recessed cavity configured to receive the elastomeric piece and may insert the customized elastomeric piece into the recessed cavity of the guard body piece to form a customized shoe guard. In some embodiments of this method, the step of scanning the shoe sole comprises using a 3D laser scanner or structured light scanner. In some embodiments of this method, the step of fabricating the customized elastomeric piece comprises 3D printing using a material selected from the group consisting of thermoplastic elastomers (TPE), silicone, and polyurethane. In some embodiments, the method may further comprise applying an adhesive to at least one of the elastomeric piece or the recessed cavity prior to insertion. In some embodiments, the recessed cavity includes one or more features selected from the group consisting of ridges, grooves, and interlocking mechanisms to secure the elastomeric piece in place. In some embodiments, the elastomeric piece is bonded to the guard body using an adhesive selected based on material compatibility. In some embodiments, the elastomeric piece is secured to the guard body using a mechanical interlock or snap-fit design. In some embodiments, the customized elastomeric piece is fabricated using additive manufacturing techniques selected from the group consisting of fused deposition modeling (FDM) and selective laser sintering (SLS). In some embodiments, the method may comprise performing a quality control process to verify fit, stability, and durability of the customized shoe guard.

This summary is provided merely for purposes of summarizing some example embodiments, to provide a basic understanding of some aspects of the subject matter described herein. Accordingly, it will be appreciated that the above-described features are merely examples and should not be construed to narrow the scope or spirit of the subject matter described herein in any way. Other features, aspects, and advantages of the subject matter described herein will become apparent from the following detailed description and figures.

The abovementioned embodiments and further variations of the present disclosure are discussed further in the detailed description.

BRIEF DESCRIPTION OF THE DRAWINGS

The accompanying drawings, which are incorporated herein and constitute a part of the specification, illustrate embodiments of the present disclosure and, together with the description, serve to explain the principles of the present disclosure.

Figure 1:
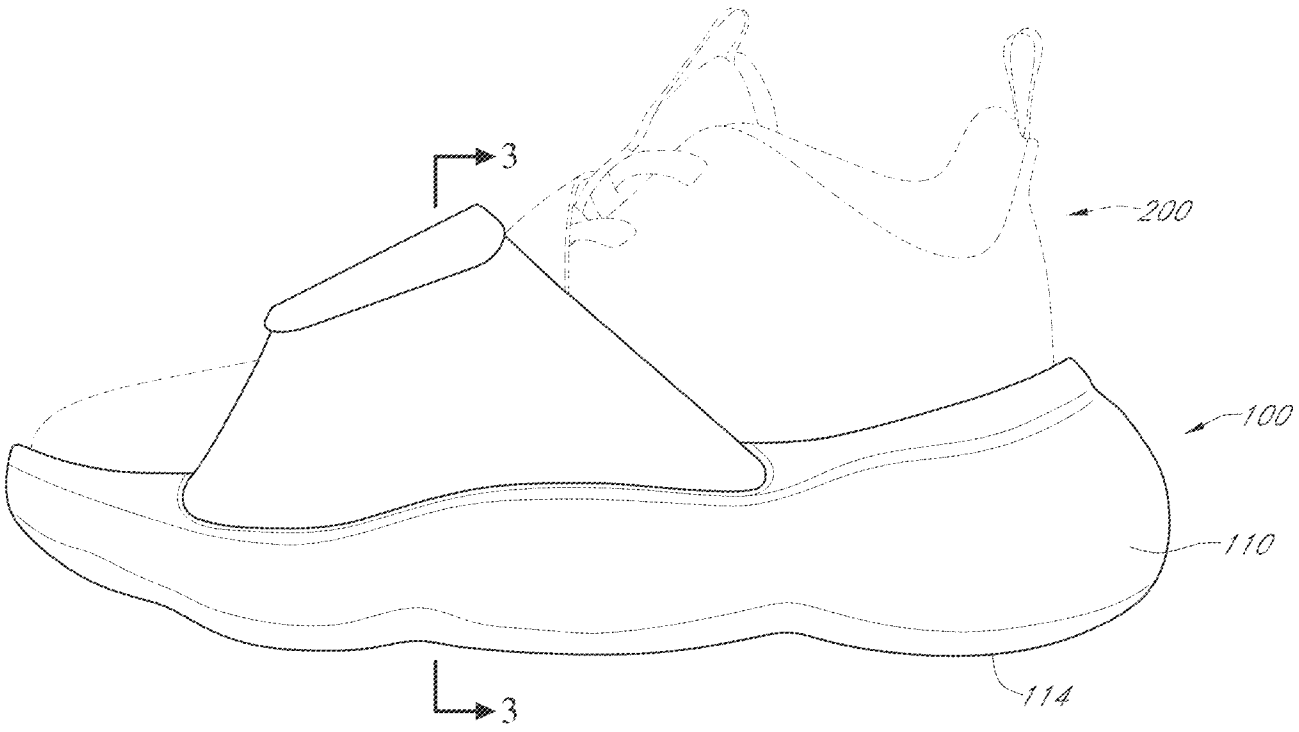
FIG. 1 is a perspective view illustrating an exemplary athletic shoe receiving a shoe guard, in accordance with one embodiment of the present disclosure.

The drawings described herein are for illustration purposes only and are not intended to limit the scope of the present disclosure in any way.

DETAILED DESCRIPTION

In the following description of the embodiments of the present disclosure, reference is made to the accompanying drawings that form a part hereof, and in which are shown by way of illustration specific embodiments in which the present disclosure may be practiced. These embodiments are described in sufficient detail to enable those skilled in the art to practice the present disclosure, and it is to be understood that other embodiments may be utilized and that changes may be made without departing from the scope of the present disclosure. The following detailed description is, therefore, not to be taken in a limited sense, and the scope of the present disclosure is defined only by the appended claims.

The specification may refer to "an", "one" or "some" embodiment(s) in several locations. This does not necessarily imply that each such reference is to the same embodiment(s), or that the feature only applies to a single embodiment. A single feature of different embodiments may also be combined to provide other embodiments.

As used herein, the singular forms "a", "an" and "the" are intended to include the plural forms as well, unless expressly stated otherwise. It will be further understood that the terms "includes", "comprises", "including" and/or "comprising" when used in this specification, specify the presence of stated features, integers, steps, operations, elements and/or components, but do not preclude the presence or addition of one or more other features integers, steps, operations, elements, components, and/or groups thereof. As used herein, the term "and/or" includes any and all combinations and arrangements of one or more of the associated listed items.

Unless otherwise defined, all terms (including technical and scientific terms) used herein have the same meaning as commonly understood by one of ordinary skill in the art to which this disclosure pertains. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In the foregoing sections, some features are grouped together in a single embodiment for streamlining the disclosure. This method of disclosure is not to be interpreted as reflecting an intention that the disclosed embodiments of the present disclosure must use more features than are expressly recited in each claim. Rather, as the following claims reflect, the inventive subject matter lies in less than all features of a single disclosed embodiment. Thus, the following claims are hereby incorporated into the detailed description, with each claim standing on its own as a separate embodiment.

Athletes routinely arrive at the court with outsoles already coated in dust and abraded by outdoor surfaces, a combination that diminishes grip, increases injury risk, and shortens shoe life. Existing countermeasures such as those described above address only fragments of this problem and introduce their own drawbacks such as waste generation, chemical residue, bulk, poor fit, or inadequate cleaning of recessed tread features.

Modern training regimens typically involve quick transitions between drills, weight-room sessions, and outdoor conditioning. An ideal traction-maintenance accessory should therefore be lightweight, easy to put on and take off, and compact enough to stow in a gym bag. Rigid devices or those requiring meticulous alignment hinder adoption. Time-pressed athletes may forgo any solution that demands more than a few seconds of setup or that cannot be cleaned and readied for the next session with minimal effort.

The present disclosure overcomes these limitations with a dual-function shoe-guard assembly that travels with the athlete. A flexible guard body forms a lightweight overshoe that shields the outsole from abrasive ground contact yet remains thin and treaded enough to walk safely on pavement. Nested within the guard body is a removable insert whose upper face carries an adhesive layer; brief contact between the shoe sole and this layer lifts particulate contamination from even the deepest grooves. The insert locks to the guard body through mating fasteners whose engagement force intentionally exceeds the adhesive's peel force, preventing the insert from detaching when the shoe is lifted away.

Supplementary design elements such as ventilation holes, antimicrobial additives, perimeter ridges, curved toe-spring regions, adjustable straps, textured bottom tread, and a choice of resilient or biodegradable substrates, may in some embodiments be provided to allow the guard to fit a broad range of athletic shoes while maintaining hygiene, comfort, and sustainability. In certain embodiments, because the insert can be cleaned or swapped out independently of the guard body, the system delivers long service life with minimal consumables, giving athletes a single, quick-deploy solution that protects, cleans, and restores traction wherever their sport takes them.

The shoe-guard assembly is built around a cooperative relationship between two primary components: (1) a guard body, and (2) a removable insert. The guard body is a flexible overshoe structure sized to cover at least the outsole area that normally makes ground contact. It presents a ground-facing bottom surface that can safely engage concrete, or asphalt and a shoe-facing top surface engineered to receive the insert. One or more fasteners such as hook-and-loop fields, molded snap posts, magnetic plates, Velcro or dovetail rails may be embedded or bonded to the top surface so that the insert may be secured in precise alignment. The removable insert has its own lower face that carries complementary fasteners and an upper face coated with an adhesive layer. When an athlete steps into the shoe guard, the shoe sole presses against the adhesive of the insert, allowing particulate matter to transfer from the tread to the insert. Because the insert is locked to the guard body rather than the floor, the athlete can lift the shoe free once cleaning is complete, leaving debris behind.

In some embodiments, the adhesive layer that contacts the outsole can be formulated for reusability. Suitable chemistries include silicone gel matrices, acrylic pressure-sensitive systems, polyurethane hot melt blends, or natural rubber lattices that recover tack after washing with mild soap and water. Fillers such as fumed silica or rosin esters may be incorporated to tune peel strength, while plasticizers preserve softness over a broad temperature range. Repeated use reduces consumable waste and permits the athlete to refresh traction multiple times during a single practice or tournament.

In further embodiments, the adhesive layer may be engineered using materials that rely on a combination of specialized polymer formulations and surface energy management. When the adhesive surface becomes fouled with dust or debris, it can be washed with water-optionally with mild detergent—to remove contaminants. Upon drying, the surface regains its original tackiness because the underlying polymer matrix and micro-textured surface are re-exposed, restoring the adhesive's surface energy. This regeneration process can be repeated many times. Materials suitable for this type of regeneration include high-performance silicone elastomers, thermoplastic elastomers with engineered surface textures, and hydrophilic acrylic copolymers that maintain adhesion properties through multiple wash-dry cycles.

In certain embodiments, to maintain adhesive performance before use, a removable protective film can be provided. The film may be die-cut from low-density polyethylene, biaxially oriented polypropylene, or coated paper, and sized to overlay the entire adhesive surface. In certain embodiments, a small pull tab facilitates removal without touching the tacky area. During storage or transport, the film shields the adhesive from lint, pocket debris, and premature dehydration, ensuring consistent peel characteristics when the insert is next deployed.

The guard body itself may be molded or extruded from highly elastic, wear-resistant materials such as thermoplastic elastomer (TPE), thermoplastic polyurethane (TPU), vulcanized natural rubber, silicone rubber, or nitrile-butadiene rubber. These compounds provide sufficient elongation to accommodate different shoe outsole contours while withstanding repeated flex cycles and abrasive contact with pavement. Wall thickness can vary, striking a balance between durability and overall weight.

In certain embodiments, the guard body extends far enough to envelop the entire outsole, from toe tip to heel edge. Full-coverage versions may be favored for outdoor transit because they eliminate any exposed tread area that might abrade or pick up contaminants. Alternatively, a reduced-coverage variant may shield only the forefoot region, which typically contains the most intricate traction pattern, thereby lowering material usage and weight.

Where partial coverage is chosen, the guard body can be extended rearward to include a heel cap or discrete heel panel, affording protection at both high-wear zones without fully encasing the mid-foot. A modular architecture lets users select between forefoot-only, heel-only, or combined forefoot-and-heel guards depending on sport-specific movement patterns.

For safe walking on slick concrete, tile, or wet pavement, the ground-facing side of the guard body can carry molded tread elements such as chevron lugs, siped bars, or concentric rings. These features are spaced and tapered to channel water away and to maintain surface contact angles that maximize static friction. A shore hardness in the 20-80 Shore A range, preferably 30-50 Shore A range, delivers adequate abrasion resistance without feeling harsh underfoot.

Long service life is supported by selecting base polymers with high tear resistance (>30 kN/m) and incorporating reinforcing fillers such as carbon black, silica, or recycled crumb rubber. Anti-oxidant packages (e.g. hindered phenols or phosphites) slow oxidative embrittlement, while UV stabilizers guard against sunlight degradation when the guard is worn outdoors.

In some embodiments, ventilation apertures or mesh windows may be molded through the guard body's upper wall to promote airflow around the shoe's midsole and outsole. Openings can be arranged in staggered rows or honeycomb patterns sized between 2 mm and 6 mm to admit air yet exclude coarse grit. The apertures reduce humidity buildup, which otherwise accelerates microbial growth and hydrolytic breakdown of EVA or PU cushioning.

The insert substrate can be compounded with antimicrobial agents such as zinc pyrithione, silver-ion ceramics, or quaternary-ammonium salts dispersed throughout the foam matrix. These additives inhibit bacterial and fungal proliferation on both the adhesive surface and within the substrate's open-cell structure, mitigating odor and athlete's-foot risk. In some embodiments, washability is achieved by choosing substrate foams such as EVA, cross-linked PE, closed-cell neoprene, or PU memory foam that tolerate immersion in mild detergent solutions without disintegrating.

The insert substrate itself may be chosen from ethylene-vinyl-acetate foam for light weight and resilience, polyurethane foam for energy absorption, natural latex for biodegradability, neoprene for tear strength, viscoelastic memory foam for conformability, gel pads for low rebound, or cork for sustainability and odor resistance. Hybrid laminates (e.g., EVA bonded to cork) can combine multiple properties in a single layer.

In some embodiments, the adhesive layer is formulated to maintain its peel strength after wash-dry cycles, enabling long-term reuse. Water-resistant performance derives from hydrophobic adhesive chemistries and from guard-body polymers that exhibit minimal water absorption (<1% by weight after 24 h immersion). This ensures the device remains functional in damp locker rooms or during light rain.

In certain embodiments, the adhesive may be engineered as a pressure-sensitive system that delivers high tack under modest compressive loads yet releases cleanly without residue. Shear modulus is tuned so the layer deforms enough to enter micro-grooves but resists cold flow. Viscoelastic balance may be quantified by a Dahlquist criterion value below $3\times10^5$ Pa at 1 Hz.

Silicone-based adhesives are especially suitable because they retain tack over a wide temperature band (−20° C. to 60° C.), exhibit excellent chemical inertness toward rubber compounds, and can be pigmented without significant loss of adhesion. Platinum-cured systems avoid leachable catalysts that might discolor shoe outsoles.

Mutual fastening between guard body and insert can be provided by hook-and-loop tape bonded with silicone pressure-sensitive adhesive, by ultrasonic-welded loop fabric laminated directly to the guard body, or by integral hook fields molded from polyamide. Fastener area and hook density are selected to supply a shear strength exceeding the maximum expected adhesive peel force.

To maintain a flush fit after placement of the insert 120 into the guard body 110, one or more shallow recesses may be molded into the guard body's top surface. Each recess depth may substantially match the thickness of the insert 120 (including the insert fastening element) and the guard body fastening element, allowing the insert's upper adhesive plane to sit level with the guard-body rim so that the outsole contacts the insert adhesive uniformly.

In some embodiments, to better accommodate various types of shoes, such as the Air Jordan 38™ and the Under Armour Curry 7™, which exhibit outsoles with differing contours and slight dimensional variances, a portion of the guard body surrounding the shoe is constructed from an elastomeric material selected for its softness and flexibility, thereby enabling the guard body to more closely conform to the shape of the shoe and providing an enhanced fit. However, it is acknowledged that while the use of a softer material may improve the fit by better accommodating the shoe's contours, it may also introduce certain drawbacks, including reduced stability or diminished structural support, which could adversely affect the overall fit and performance of the shoe guard. In certain embodiments, the elastomeric material employed for the guard body portion surrounding the shoe exhibits a durometer hardness ranging from approximately 10 Shore A to 90 Shore A, preferably between 20 Shore A and 80 Shore A, more preferably between 30 Shore A and 60 Shore A, and even more preferably within ranges of 40 Shore A to 50 Shore A or 50 Shore A to 70 Shore A, wherein the Shore A hardness is measured in accordance with ASTM D2240, the standard test method for rubber property—durometer hardness. These specified ranges are selected to strike an optimal balance between providing a secure fit and ensuring adequate stability for the shoe guard.

In certain additional embodiments, the elastomeric material of the guard body portion surrounding the shoe may further incorporate specific types of particles to enhance its ability to conform to various shoe shapes and sizes. These particles can be selected to improve the flexibility, compressibility, and conformability to the material used for the guard body portion surrounding the shoe, thereby improving its fit across a wider range of shoe contours. For example, in some embodiments, hollow microspheres or microbeads, such as expanded polystyrene (EPS) or hollow glass microspheres, may be incorporated into the elastomeric material. These particles, with their spherical shape and low density, enable the guard body portion surrounding the shoe to more easily compress and adapt to irregular shoe shapes, while maintaining a relatively low weight.

In other embodiments, fine rubber particles or latex powders may be mixed with the elastomeric material to enhance elasticity and allow the material to stretch and better accommodate variations in shoe dimensions. These materials provide increased softness and tackiness, ensuring that the shoe guard provides a more custom fit to the wearer. The use of such particles may also enhance the grip of the guard body to the shoe sole, further securing the shoe guard in place.

Additionally, in some embodiments, fumed silica or talc may be added as micronized fillers to the elastomeric material. These fine particles can enhance the viscoelasticity of the guard body portion surrounding the shoe, which allows for improved flexibility and formability, particularly when adapting to slight dimensional discrepancies in shoe sizes. The inclusion of these materials also provides an improved balance between softness and structural support, ensuring that the guard body conforms to the shoe's contours without sacrificing stability.

In yet another embodiment, polymeric gel particles may be incorporated into the elastomeric material to provide localized areas of softness and impact absorption. These gel particles, such as polyurethane or silicone gels, allow the guard body to better adapt to different shoe shapes by providing a cushioned fit around areas of high pressure or uneven contour. This feature may be especially beneficial for shoes with more complex or irregular outsole profiles.

Furthermore, in some embodiments, microcellular foam particles may be added to the elastomeric material to create a more compressible and flexible structure. These particles are capable of reducing the hardness of the guard body portion surrounding the shoe, while simultaneously enhancing its ability to adapt to subtle variations in shoe contours. Materials such as EVA foam particles, polyurethane foam, or microcellular silicone can be used to achieve this effect. The foam particles also help maintain a lightweight design while improving the fit and comfort of the shoe guard.

The addition of carbon black or carbon nanotubes may also be considered in certain embodiments, as these particles can improve the strength and toughness of the elastomeric material, while still allowing it to maintain an optimal level of flexibility. These materials contribute to the durability of the guard body portion surrounding the shoe, ensuring that this portion can withstand repeated use while still conforming well to different shoe shapes.

In each of these embodiments, the particles are selected to achieve an optimal balance between flexibility and structural integrity, providing a better fit for shoes with varying contours and sizes. The inclusion of these particles helps ensure that the shoe guard conforms securely to the shape of the shoe, while maintaining stability and performance, especially for shoes with outsoles exhibiting significant dimensional variances.

A deliberate force hierarchy is established between the components of the shoe guard. Specifically, the mechanical engagement strength (shear and peel) between the guard body and the insert is engineered to exceed the adhesive peel strength between the insert and the shoe sole by greater than 10% during the insert's first use, preferably by at least 20%, and more preferably by between 30% and 80%. In certain embodiments, the fastening force between the guard body fastener and the insert fastener falls within one the following ranges: from 1000 gram-force (gf) to 2000 gram-force (gf), from 2000 gram-force (gf) to 5000 gram-force (gf), or from 5000 gram-force (gf) to 10000 gram-force (gf). These ranges are selected based on the application needs, with the lower range typically used for standard applications, the other range for high-performance footwear. The difference in mechanical engagement strength compared to the adhesive peel strength ensures that, when the wearer removes the shoe from the shoe guard, the insert does not detach from the guard body. Instead, the insert remains securely attached to the guard body while the shoe is removed, preventing unintended detachment of the insert and ensuring that debris remains captured within the guard.

In certain embodiments, the strength of the attachment between the insert and the guard body can be controlled by varying the coverage of the fasteners (e.g., Velcro) on the opposing surfaces of the insert and guard body. For example, in some embodiments, the lower surface of the insert may be covered with fasteners over a range of from 20% to 70% of the insert's total surface area, and the upper surface of the guard body may be similarly covered with fasteners over a range of from 30% to 90%. The coverage area can be adjusted based on the desired attachment strength and performance requirements. For example, in certain embodiments, the lower surface of the insert could be covered with fasteners over a smaller area, such as from 10% to 50%, to provide a less aggressive attachment suited for applications where easy detachment is necessary. In other embodiments, the insert could have a greater coverage area of from 60% to 80% for stronger attachment, ideal for use cases requiring more secure engagement, such as in high-performance applications. In some embodiments, the upper surface of the guard body could be covered within the range of 20% to 60%, allowing for fine-tuning the balance between secure attachment and ease of removal. For particularly demanding environments, coverage in excess of 70% could be utilized to maximize the attachment strength.

Additionally, varying the coverage ratio between the insert and the guard body allows for optimization based on specific use cases. For example, if the shoe guard is designed for athletic footwear (e.g., basketball shoes), the lower surface of the insert may be covered with fasteners in the range of 40% to 60%, while the upper surface of the guard body could have coverage ranging from 50% to 70%. This configuration provides a strong attachment while still allowing for some flexibility during high-intensity movements. For everyday use, the insert's fastener coverage may be reduced to between 30% and 50%, with the corresponding coverage on the guard body between 40% and 60%, ensuring a balance of both fit and ease of removal. In applications where enhanced durability and resistance to forces are required, the insert may have a coverage area of 60% to 80%, while the guard body could have a coverage range of 70% to 90%, providing maximum engagement strength for extreme-use footwear, such as for heavy-duty or industrial settings.

In some embodiments, the attachment strength can be adjusted by varying the density of the fasteners, quantified by the number of hooks and loops per unit area. For example, on the lower surface of the insert, the density of the hooks may range from 100 to 500 hooks per square inch (hpi), while the upper surface of the guard body may have a loop density ranging from 150 to 600 loops per square inch (lpi). In certain embodiments where easier removal is desired, lower-density fasteners may be used, with hook densities ranging from 100 to 200 hpi and loop densities ranging from 150 to 250 lpi. This low-density arrangement allows for quick disengagement while maintaining a reliable attachment. For general-use applications requiring a balance of strength and case of removal, hook densities in the range of 200 to 350 hpi and loop densities of 250 to 400 lpi are suitable. For high-performance applications requiring greater attachment strength and durability, higher-density fasteners may be used, with hook densities ranging from 350 to 500 hpi and loop densities ranging from 400 to 600 lpi. These higher densities provide a more secure attachment, capable of withstanding significant forces, making them ideal for use in certain sports footwear.

Alternatively, in other embodiments, the loops may be placed on the insert surface while the hooks are placed on the guard body surface. In such embodiments, similar density ranges can be used for both the hooks on the guard body and the loops on the insert, maintaining the balance of attachment strength and case of detachment. For low-density applications, loop densities may range from 100 to 200 lpi on the insert, with hook densities of 150 to 250 hpi on the guard body. For medium-density applications, loop densities of 200 to 350 lpi on the insert, combined with hook densities of 250 to 400 hpi on the guard body, provide a reliable, balanced attachment. For high-performance applications, loop densities on the insert may range from 350 to 500 lpi, with corresponding hook densities on the guard body of 400 to 600 hpi. These variations in hook and loop configurations provide customization options for different footwear types and performance requirements.

The thickness of the fasteners can be specifically designed to influence the mechanical engagement strength between the insert and the guard body. In certain embodiments, the fasteners may have a thickness ranging from 0.2 mm to 1.5 mm, with thicker elements generally providing a stronger attachment. In other embodiments, for applications requiring a more flexible fit, the fasteners may have a thickness in the range of 0.2 mm to 0.5 mm, allowing for easier detachment while still maintaining adequate engagement strength. In further embodiments, for higher-performance applications, where durability and strength are critical, the fasteners may range from 0.7 mm to 1.5 mm in thickness. In yet other embodiments, for heavy-duty applications, where the fastener must withstand substantial forces without failing or losing engagement, the fasteners may have a thickness of up to 2 mm.

Optional retention straps extend over the shoe's vamp, instep, and or heel area. They may be fabricated from woven nylon webbing or elastic knit bands and terminated with hook-and-loop tabs, snap buckles, or cam locks. Padding can be added along strap undersides to prevent pressure points, and reflective yarns or heat-transfer films enhance visibility in low-light environments.

In some embodiments, the insert's upper face can incorporate a gentle upward curvature along its anterior margin to match the toc-spring geometry common in basketball and volleyball shoes. A radius between 40 mm and 70 mm allows the adhesive layer to contact the outsole's forward curve, ensuring dust removal across the full tread pattern.

In some embodiments, the guard body may include a continuous wall or ridge that rise above the guard body's top surface around its perimeter. This wall acts as a mechanical stop that lateral migration during walking. The ridge may be molded integrally from the same elastomer or formed as an over-molded stiffer thermoplastic to add structural rigidity without compromising flexibility elsewhere.

Figure 2:
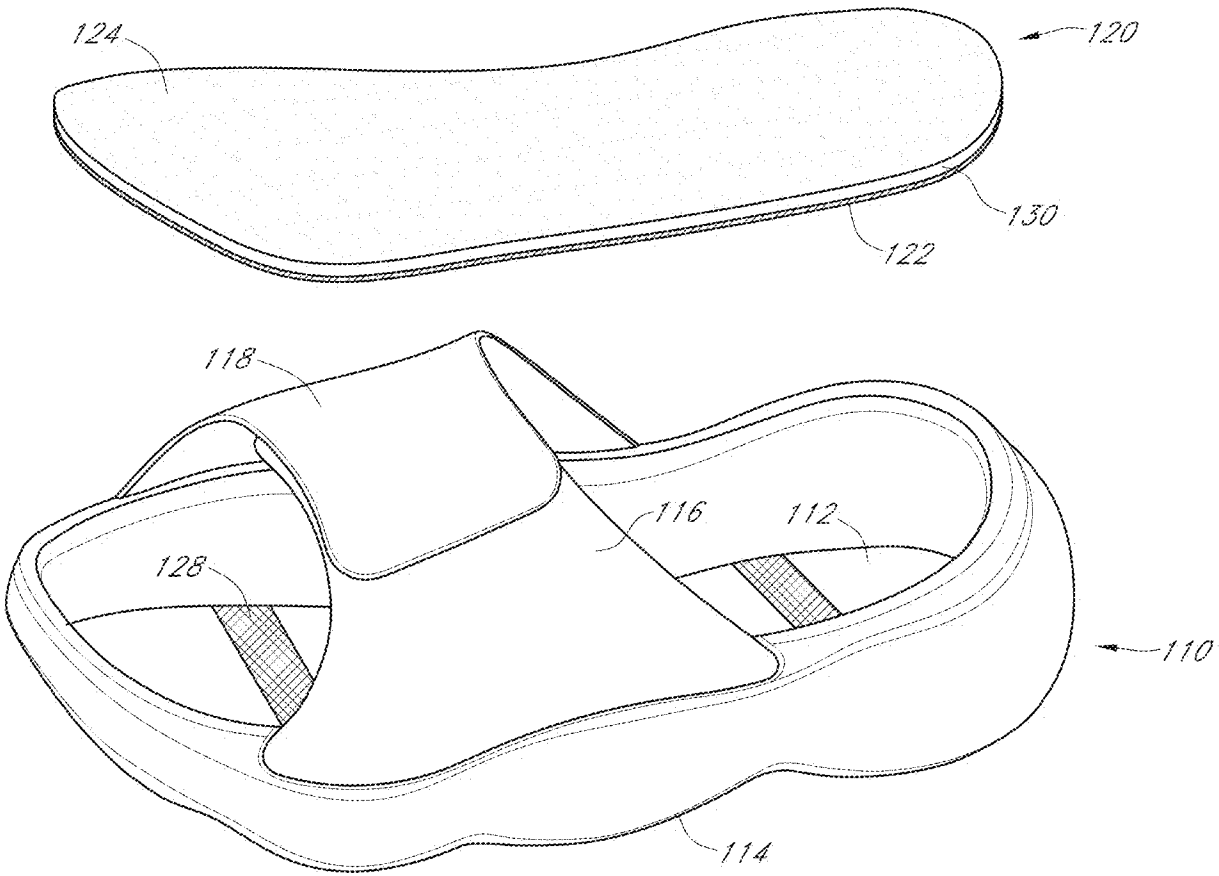
FIG. 2 is a perspective view of the shoe guard, showing the guard body and insert components according to one embodiment of the present disclosure.

Referring to the figures, FIG. 1 is an exemplary illustration of a shoe protected by a shoe guard and FIG. 2 is an exemplary perspective view illustration of the shoe guard depicting a guard body and an insert according to the embodiments of the present disclosure. The figures depict an athletic shoe 200 outfitted with the shoe-guard in its fully engaged state. The flexible guard body 110 envelopes the outsole region that normally contacts the floor, shielding it from abrasion while the athlete walks on non-court surfaces. A bottom surface 114 of the guard body 110 faces downward and presents a molded tread pattern for outdoor traction, whereas a top surface 112 faces the shoe sole and carries guard-body fasteners concealed beneath the shoe. Two opposed flaps, a first flap 116 on the medial side and a second flap 118 on the lateral side, span across the vamp of the shoe to stabilize the assembly; the flaps mate with one another through hook-and-loop patches, snaps, or other closures.

FIG. 2 is a perspective view of the shoe guard, showing the guard body 110 and insert 120 components according to one embodiment of the present disclosure. The top surface 112 of the guard body 110 includes one or more fastening engagement elements 128, such as loop fields in a hook-and-loop system, which are structured to engage with complementary hook elements 122 located on the bottom surface of the insert 120. As illustrated, the fastening elements 128 do not necessarily cover the entire top surface 112 of the guard body. This visual detail corresponds with prior descriptions in which the fastener coverage area may vary depending on the desired attachment strength and application. The insert 120 is positioned above the guard body 110, revealing its bottom surface 122 with hook elements and its top surface 124 bearing an adhesive layer (indicated by stippling). Also visible in this figure are the medial and lateral flaps (116 and 118), previously described in connection with FIG. 1, which help secure the shoe within the guard body during use.

Figure 3:
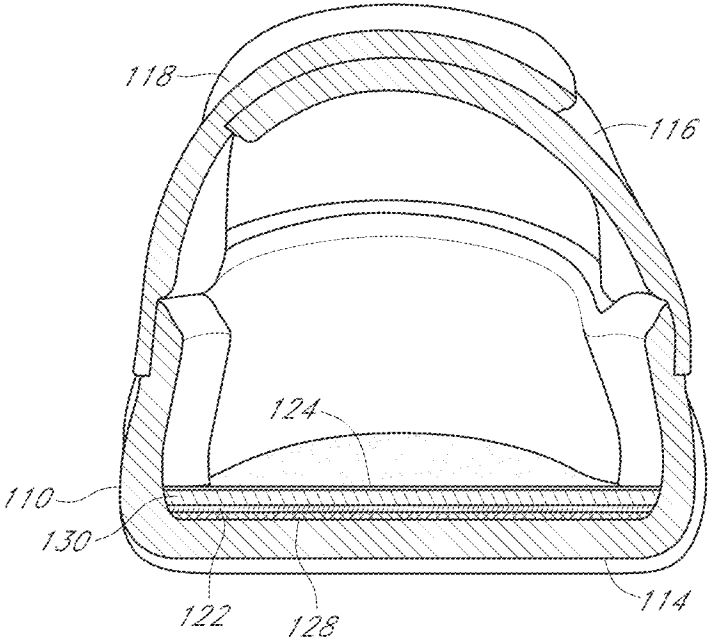
FIG. 3 is a front view of the shoe guard assembly, illustrating the curvature and alignment of the guard body and insert with the shoe's forefoot, according to one embodiment of the present disclosure.

FIG. 3 illustrates a front elevation view of the shoe guard assembly, showing how the athletic shoe 200 is positioned within the protective guard. From this perspective, the curvature of both the guard body and the underlying insert is clearly visible, with the components conforming closely to the upwardly arched front portion of the shoe's outsole, such that the curved forefoot is securely enveloped and supported. The figure also depicts the interaction between the guard body 110 and the insert 120, as well as the fastening mechanism that secures the components together. As shown, in the embodiment illustrated in FIG. 3, the guard body 110 includes guard body engagement elements 128, which are configured to engage insert engagement elements 122 located on the bottom surface of the insert substrate 130. Above the insert substrate 130 is the adhesive layer 124, which is used to adhere the insert to the shoe sole. In certain embodiments, a hook and loop fastening mechanism is employed, wherein the guard body engagement elements 128 comprise loops, and the insert engagement elements 122 comprise hooks. Alternatively, in other embodiments, the guard body engagement elements 128 may comprise hooks, while the insert engagement elements 122 comprise loops. These variations in the engagement elements allow for adjustable fastening strength depending on the application requirements.

Figure 4:
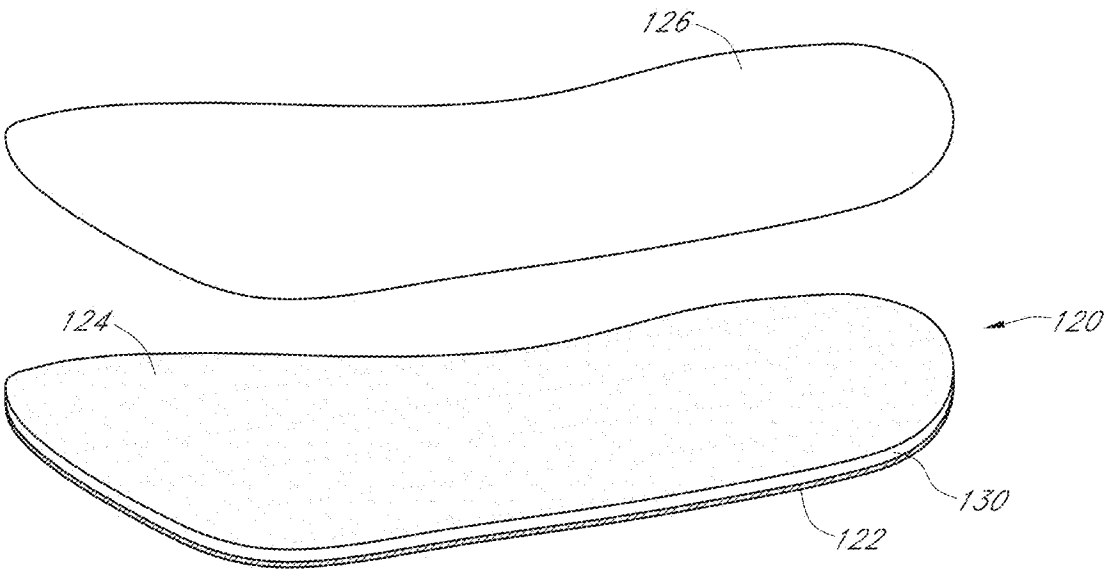
FIG. 4 is a perspective view of the insert and a removable protective film, in accordance with one embodiment of the present disclosure.

FIG. 4 illustrates the insert assembly. The insert 120 is shown with a protective film 126 peeled off to expose the adhesive layer on the insert top surface 124. In some embodiments, the film 126 includes a small tab that allows for easy grip and manipulation with a finger, enabling hygienic removal without touching the tacky region. Portions of the insert bottom surface comprises insert engagement elements 122 that engage them to guard body engagement elements 128 located at portions of the top surface of the guard body 110. In certain embodiments, edge chamfers on the insert substrate assist in guided seating inside the guard body.

Figure 5A:
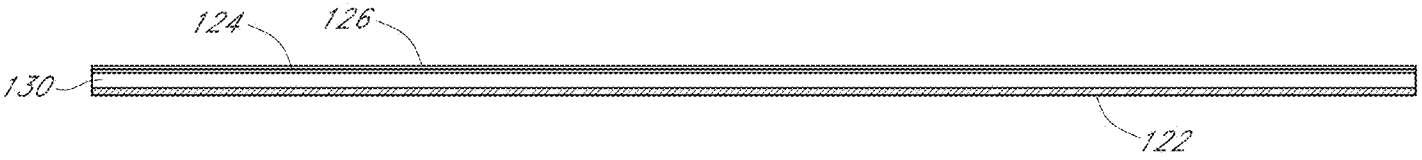
FIGS. 5A and 5B are side views of the insert, illustrating structural features according to certain embodiments of the present disclosure.
Figure 5B:
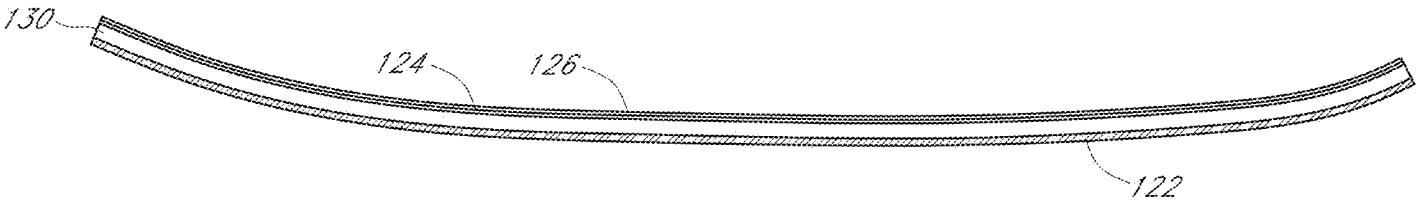

FIG. 5A illustrates an insert embodiment in plan view. The insert 120 is fabricated as a flat pad whose dimensions correspond to the forefoot zone of an athletic shoe. Reference numeral 124 again designates the adhesive-bearing top surface, while numeral 122 corresponds to insert engagement elements located on the bottom surface of the insert. Rounded edges allow easy insertion into a matching recess in the guard body 110. FIG. 5B presents an alternative insert embodiment having a curved anterior region. In this configuration the insert top surface 124 rises in an arc that mirrors the toe-spring angle of performance footwear, enabling the adhesive to make full contact with forward tread elements that would otherwise hover above a flat pad. The curvature transitions smoothly to a flat mid-section so that the bottom surface can still lock onto the fastener field of the guard body 110. The same protective film 126 used in FIG. 4 may be supplied in a pre-curved form to conform to this profile. The insert is flexible in nature and adheres with the shape of the shoe sole as well as the shoe guard.

Figure 6:
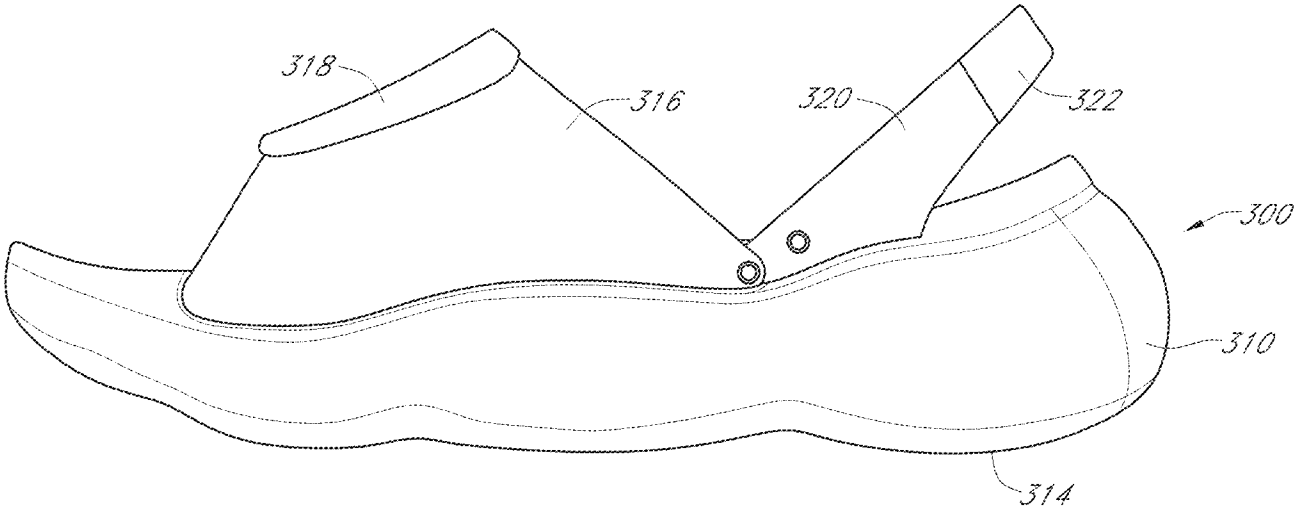
FIG. 6 is a side view of another embodiment of the shoe guard, showing alternative design features.

FIG. 6 illustrates an alternative embodiment of the shoe guard assembly 300, which is structurally similar to the embodiment shown in FIGS. 1 and 2, but includes an additional rear securing mechanism for enhanced fit and stability. The guard body 300 includes a bottom surface 314 and a top surface (not labeled in this figure), similar in function to the bottom surface 114 and top surface 112 of the previously described embodiment. A pair of front flaps, first front flap 316 and second front flap 318, extend from opposite sides of the forefoot region of the guard body 300. These flaps are configured to span across the vamp of the shoe and engage one another using fastening mechanisms such as hook-and-loop patches, snaps, or other closures, similar to flaps 116 and 118 in the embodiment of FIG. 1. Additionally, a pair of rear flaps, first rear flap 320 and second rear flap 322, extend from opposite sides of the heel region of the guard body 300. These rear flaps are configured to wrap around the heel portion of the shoe and engage one another using similar fastening mechanisms. This rear strap system provides additional securement of the shoe 200 within the shoe guard, particularly during dynamic movement or when walking on uneven surfaces.

Figure 7:
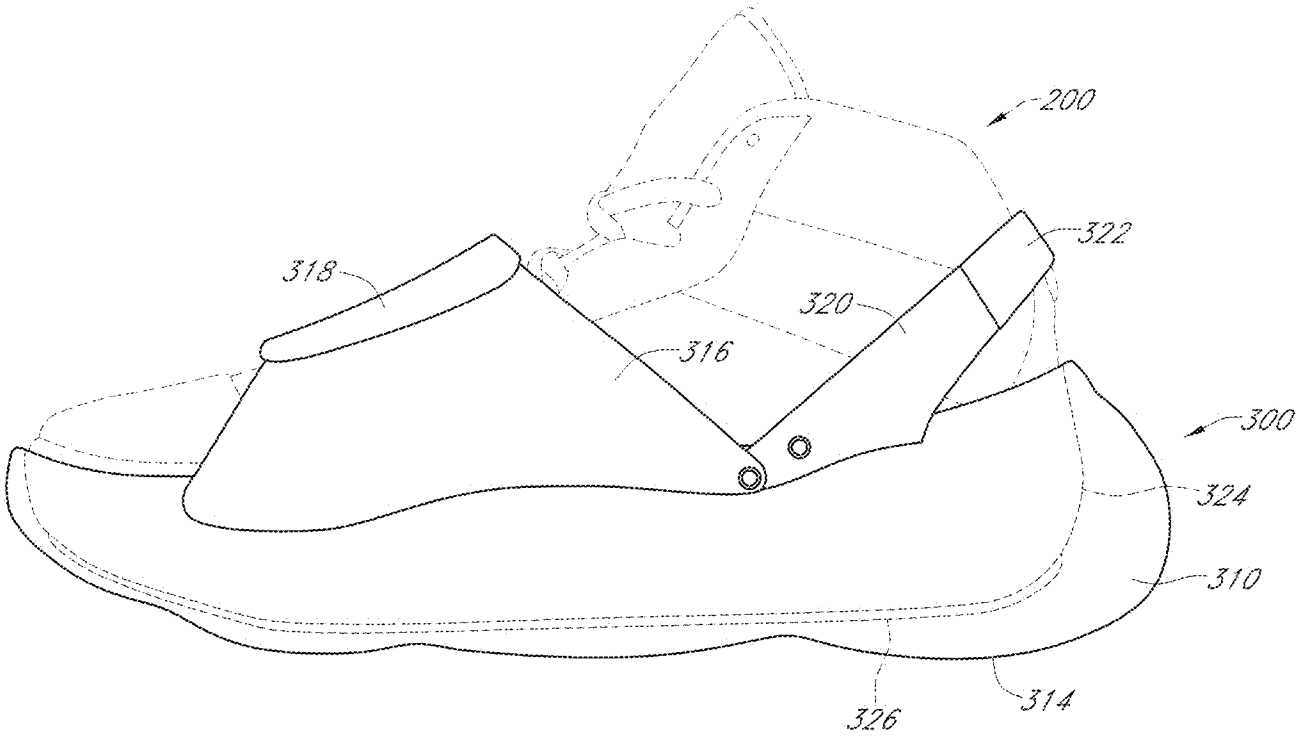
FIG. 7 is a side view of the shoe guard embodiment of FIG. 6, shown with a shoe inserted therein.

FIG. 7 shows the same embodiment as FIG. 6, but with an athletic shoe 200 inserted into the shoe guard assembly 300. The bottom surface 314 of the guard body 300 is visible, and the front flaps 316 and 318 are shown extending across the vamp of the shoe, while the rear flaps 320 and 322 wrap around the heel region. These flaps are engaged using fastening mechanisms such as hook-and-loop patches, snaps, or other closures, securing the shoe 200 within the guard body 300.

A shallow recess 326 is defined in the top surface of the guard body 300, corresponding to the insert-receiving cavity previously described. This recess is dimensioned to accommodate the insert and any associated fastening elements (such as a hook-and-loop (Velcro™) system) so that the adhesive-bearing top surface of the insert sits flush with or slightly below the surrounding top surface of the guard body, ensuring uniform contact with the shoe sole.

In one embodiment, the recess depth may range from about 1.0 mm to 2.0 mm, suitable for thin inserts with minimal or integrated fastening layers, such as micro-hook adhesives or magnetic couplings. In another embodiment, the recess depth may range from about 2.0 mm to 5.0 mm, which accommodates typical foam-based inserts with hook-and-loop fasteners, where the insert substrate is about 2.5-3.5 mm thick and the fastener layer adds 0.5-1.0 mm. In yet another embodiment, the recess depth may range from about 5.0 mm to 7.0 mm, allowing for thicker inserts with dual-layer construction or enhanced cushioning, while still maintaining a flush fit with the surrounding top surface.

The recess may also include beveled or chamfered edges to facilitate guided insertion and reduce pressure points. A silhouette outline 324 is shown to indicate the position of the shoe 200 within the guard body 300, providing visual context for how the shoe is seated and retained during use.

Figure 8:
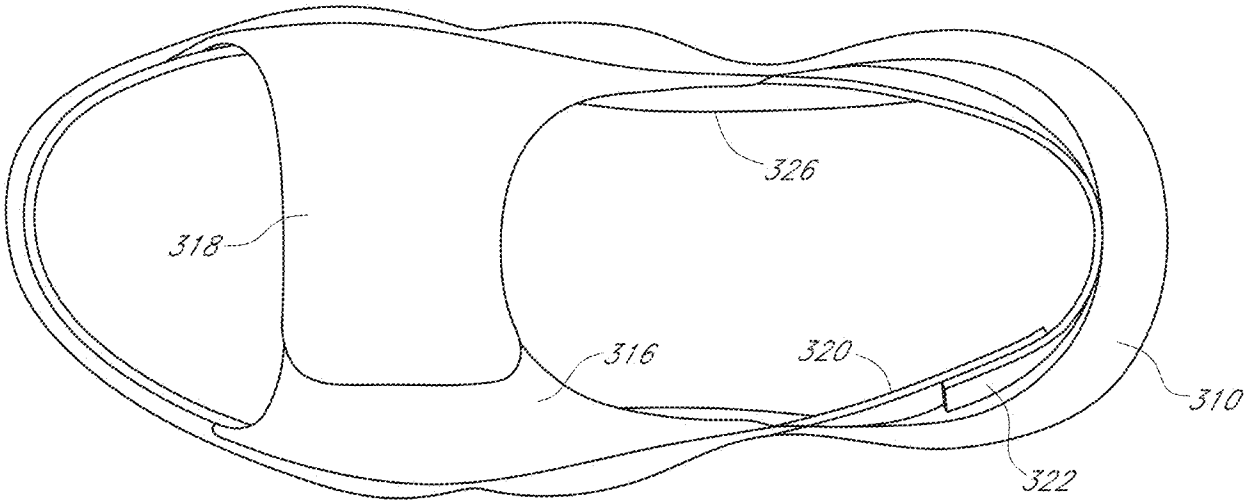
FIG. 8 is a top plan view of the shoe guard embodiment shown in FIGS. 6 and 7.
Figure 9:
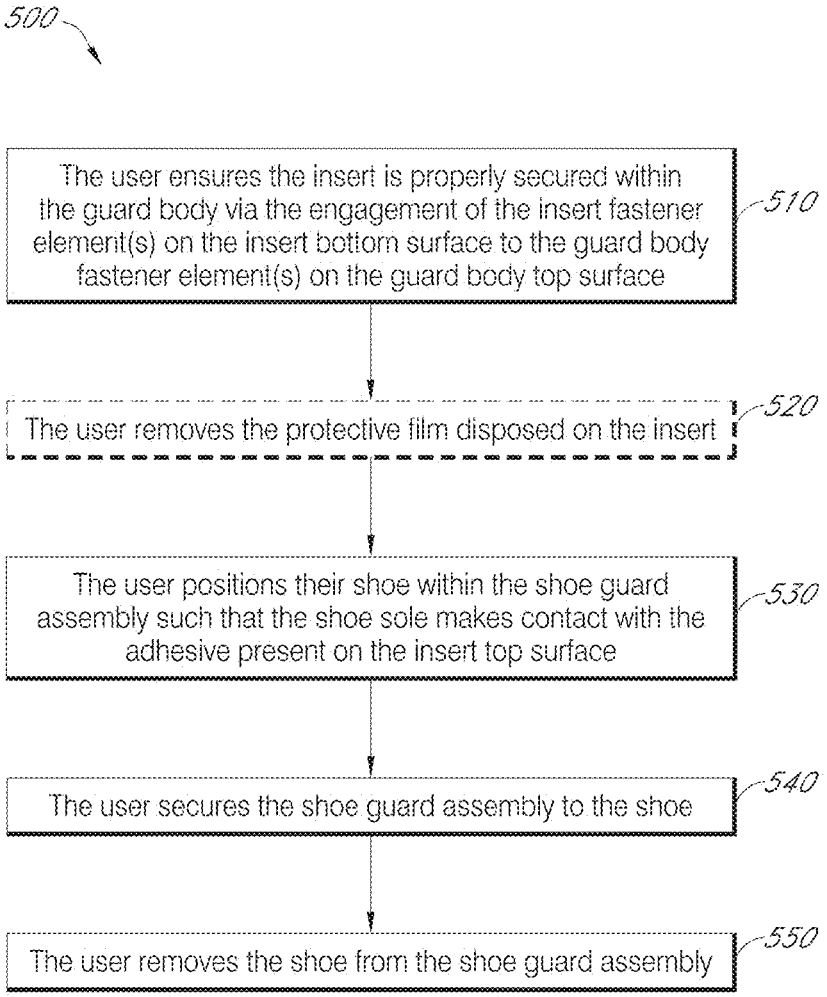
FIG. 9 is a flowchart illustrating an exemplary method for using the shoe guard, including steps for preparing the insert, inserting the shoe, and removing the shoe while retaining the insert in place.

FIG. 8 presents a top plan view of the shoe guard assembly 300 with the insert placed onto the guard body. The figure shows the front flaps 316 and 318, which extend from opposite sides of the forefoot region of the guard body 300 and are configured to span across the vamp of the shoe. These flaps are designed to engage one another using fastening mechanisms such as hook-and-loop patches, snaps, or other closures, similar to flaps 116 and 118 in the embodiment of FIG. 1. The rear flaps 320 and 322 are also visible, wrapping around the heel region to provide additional retention. The outline 326 represents the boundary of the recessed cavity in the guard body 300, which is designed to receive the insert and maintain its position during use. This view highlights the full perimeter of the guard body and the spatial relationship between the insert cavity and the securing flaps, illustrating how the assembly conforms to and retains the shoe during wear.

In some embodiments, the insert may include a user-accessible tab, pull loop, or raised grip feature extending slightly beyond the perimeter of the recessed cavity defined by the guard body. This tab is positioned to remain exposed when the insert is fully seated, allowing the user to easily grasp and lift the insert for removal. The tab may be formed integrally with the insert substrate or attached as a separate flexible component, and may include a textured or ribbed surface to improve grip. This feature facilitates removal of the insert from the guard body, particularly in embodiments where the insert is secured by high-strength fasteners such as hook-and-loop systems, magnetic couplings, or snap-fit mechanisms. In some embodiments, the tab may be color-coded or labeled to indicate the direction of removal or to distinguish between different insert types.

The shoe-guard assembly delivers a suite of interrelated benefits that address every stage of an athlete's routine. Because the device merges an overshoe that shields the outsole during transit with an adhesive insert that cleans the tread moments before play, athletes no longer need to carry a second pair of shoes, hunt for a sticky mat, or apply chemical sprays. The mechanical fastener system is intentionally stronger than the adhesive's peel force, so the insert remains locked in place when the athlete lifts a freshly cleaned shoe; debris stays behind, the outsole stays residue-free, and the insert can be washed and reused, sharply reducing waste compared with disposable mats or films. Materials such as high-elongation thermoplastic elastomers, antimicrobial foams, and water-resistant silicone adhesives make the assembly light, durable, and hygienic, while optional ventilation apertures and moisture-shedding compounds inhibit bacterial growth and odor. A treaded ground-contact surface lets users walk safely across wet concrete or dusty asphalt, curved insert profiles conform to toe-spring geometry for full-area cleaning, and adjustable straps or heel clips accommodate everything from low-tops to high-tops without pressure points. Custom colors, logo molding, and inserts with different tack levels give teams and retailers branding and performance flexibility, and because only the insert needs periodic replacement, long-term ownership cost remains low.

Numerous alternative embodiments are contemplated. In some embodiments, magnets embedded in the guard body can snap to ferromagnetic foil on the insert, creating a silent, lint-proof coupling that never wears out. A dovetail rail molded around the guard's perimeter can engage a matching groove on the insert, locking the pad laterally while leaving its adhesive face uncontaminated by hook-and-loop fibers. In certain embodiments, self-healing adhesives are used that contain micro-encapsulated tackifiers can rupture under pressure to refresh surface stickiness, extending service life even further, while dual-density laminates combine a soft, dust-capturing upper layer with a firmer structural base for heavier athletes or sprint-intensive sports. Disposable peel skins can be applied atop the insert for tournaments that demand rapid, between-game refresh; once saturated, only the thin skin is discarded while the core insert remains. A molded heel clip can latch onto the shoe's counter to prevent axial migration during hard back-pedals, and color-changing indicator pigments embedded in the adhesive can tell the user when dust saturation has reached a threshold that warrants cleaning or replacement. Variants formulated with fluorosilicone adhesives and high-temperature elastomers perform on scorching outdoor asphalt, whereas low-glass-transition elastomers and glycerol-modified tack layers keep the device supple on winterized gym floors. A rigid clam-shell travel case can double as a standing cleaning station, holding spare inserts and letting an athlete step in while seated on a bench.

The versatility of the present disclosure unlocks a wide range of practical scenarios. During multi-day basketball tournaments players can move between hotel, bus, and arena while keeping soles pristine for every tip-off. Volleyball teams that drill continuously in shared gyms can refresh traction between rotations without leaving the court. Futsal clubs that rent community centers lacking professional sticky mats can bring their own portable solution and share it among teammates. Competitive dancers and rhythm-game enthusiasts gain a chemical-free way to maintain floor grip, avoiding sprays that mar studio surfaces. Medical staff who commute in athletic footwear can strip debris before entering sterile hospital zones, replacing disposable peel-away mats. Military recruits preserve boot tread when shifting from outdoor obstacle courses to indoor training halls. Physical-therapy patients practicing balance exercises benefit from consistent shoe-floor interaction, reducing fall risk. Shoe retailers can let customers test grip on new sneakers without dirtying display models, and factory or warehouse visitors can don the guard over safety shoes to avoid tracking dust onto polished office floors. Home-gym users training in garages or basements can keep their court shoes game-ready without installing bulky adhesive mats or risking damage to home flooring. Through this broad palette of advantages, configuration options, and contexts of use, the shoe-guard assembly demonstrates a comprehensive capacity to solve longstanding traction, hygiene, and outsole-protection challenges across athletic, industrial, medical, and everyday environments.

Further embodiments may enhance the cleaning efficacy and user experience through advanced features and materials. For instance, the removable insert itself can incorporate a multi-stage cleaning architecture. In some embodiments, two or more adhesive strata are stacked or zoned laterally to target different particle sizes. A first, higher-peel-strength layer might engage large grit and fibrous debris, while a subjacent or peripheral layer formulated with a softer viscoelastic matrix wicks fine talc and court finish dust from micro-sipes. These layers may be co-laminated during die-cutting or sequentially coated onto the substrate. Where zoned laterally, features like concentric rings or chevron bands of differing tack could provide progressive cleaning as the user rocks the shoe.

In certain embodiments, the adhesive layer on the insert is zoned to correspond with the biomechanical demands of athletic movement. For example, in basketball, the forefoot region of the shoe is heavily engaged during rapid cuts, pivots, and directional changes. To support these movements, the insert may include a higher-tack adhesive zone aligned with the forefoot area of the shoe sole. This localized increase in peel strength enhances debris removal and traction restoration where it matters most, while allowing lower tack in less critical areas to facilitate easier shoe removal and reduce adhesive wear.

In some embodiments, the adhesive peel strength in a first region of the insert (e.g., the forefoot zone) is greater than in a second region (e.g., the midfoot or heel zone). The difference in peel strength may range from approximately 20% to 50%, or in further embodiments, from 30% to 100%, depending on the desired traction profile and ease of release. This variation may be achieved by using different adhesive formulations in each region such as a high-tack silicone-based adhesive in the forefoot and a lower-tack acrylic adhesive in the heel, or by varying the density or thickness of a single adhesive formulation across the insert surface. In some embodiments, the adhesive may be applied in patterned zones, such as chevrons or concentric arcs, to guide foot placement and optimize cleaning performance.

The tackiness of the exposed adhesive surface can also be user-adjustable in certain embodiments. One approach involves embedding micro-encapsulated plasticiser or solvent droplets within the adhesive matrix; compressive load during use ruptures a proportion of these capsules, momentarily lowering viscosity and refreshing surface stickiness. Another variant might utilize a peel-back mask covering fractional areas of the pad, allowing users to remove incremental segments to expose fresh adhesive and thereby 'dial in' the desired traction response between uses or games without replacing the entire insert.

To enhance wearer experience, the adhesive matrix or insert substrate may be loaded with functional additives. These can include slow-release deodorizing agents, such as cyclodextrin-complexed fragrances or activated-carbon micro-particles. Additionally, optional phase-change micro-capsules (e.g., paraffin embedded in urea-formaldehyde shells) could be incorporated to absorb and gradually release excess heat generated during intense activity, helping to maintain a more stable in-shoe temperature.

Integration with electronics is also contemplated without compromising the flexibility of the assembly. In some advanced embodiments, a thin piezo-electric film or printed capacitive array could be laminated beneath the adhesive surface to record contact pressure distribution. Data from such sensors might be routed via an ultra-low-profile flexible circuit to a low-power communication module (e.g., Bluetooth Low Energy-BLE) housed, for example, within a pocket in the guard body 110. This module, potentially powered by a coin cell, could transmit data such as cleaning-cycle counts, pressure maps, or insert-replacement prompts to a companion mobile application. Simpler embodiments could embed passive tags, like NFC or UHF-RFID chips, within the insert substrate to store manufacturing batch data or usage information, retrievable via suitable readers for inventory or equipment management purposes.

Manufacturing techniques can be employed to combine dissimilar materials or create optimized structures. For example, the guard body side walls might be over-molded onto a pre-knitted textile sleeve (e.g., polyester or aramid) to enhance tear resistance at strap anchor points while maintaining high stretch in other areas. Dual-durometer co-extrusion could yield a guard body with a softer upper flange for conforming to the shoe midsole and a harder, more abrasion-resistant tread layer below. Furthermore, insert substrates could be fabricated using additive manufacturing (e.g., fused-filament fabrication or selective laser sintering of materials like TPU) to create complex geometries such as lattice structures with density gradients, optimized for specific activities or foot-strike patterns (e.g., denser under the forefoot for jumping, lighter at the arch).

From a manufacturing perspective, achieving a substantially universal fit often necessitates molds or dies capable of producing multiple sizes or highly elastic materials that return to shape without permanent deformation. Yet high-elongation elastomers sometimes suffer from tear propagation at thin sections, especially around ventilation apertures or strap anchor points. Integrating walls or ridges to retain a removable insert introduces additional molding complexity and potential weak points where flash or knit lines form. Maintaining dimensional tolerances so that an insert sits flush with the guard body's top surface can be important; protrusions could create localized pressure that imprints outsole rubber or affects biomechanics.

Alternative closure mechanisms can provide enhanced convenience or fit. In place of traditional flaps or straps, embodiments could feature a wrap-around ankle gaiter integrated with the guard body, coupled to a micro-adjustable dial-and-cable closure system (e.g., BOA® technology or similar). Such systems allow for precise, even compression across the instep and facilitate rapid, potentially one-handed, putting on and taking off of the shoe guard.

The material composition of the guard body can be tailored for specialized environments beyond standard sports courts. Anti-static formulations incorporating conductive fillers could reduce static discharge, enabling safe use in electronics manufacturing or handling areas (e.g., meeting $<10^8$ ohms resistance). For use in commercial kitchens or industrial settings with oil exposure, tread compounds blended with materials like nitrile rubber and silica can provide enhanced resistance to swelling and slippage. Where fire-retardancy is necessary, halogen-free intumescent additives or phosphorous-based flame retardants may be incorporated into the guard body elastomer to meet relevant safety standards (e.g., ASTM F2413 or EN ISO 20345).

End-of-life considerations can be designed into the shoe guard assembly. Score-lines or designated separation points could be molded into the guard body, for example, at the junction between the tread layer and side wall, facilitating manual separation into monomaterial components for easier recycling.

Both the insert substrate and the adhesive used on the insert may be manufactured from a variety of materials, including environmentally friendly, biodegradable, or compostable options, as well as some materials selected for their performance characteristics. For the insert substrate, materials such as polylactic acid (PLA) foam, polyhydroxyalkanoates (PHA) foam, starch-based foam, cellulose acetate, and chitosan are biodegradable and derived from renewable plant-based resources. In some embodiments, these materials may be used for their environmental benefits, such as biodegradability, sustainability, and potential for compostability. For example, PLA and PHA foams are biodegradable plastics made from plant sugars and bacterial fermentation, respectively, while starch-based foams are derived from agricultural feedstocks. Materials such as cork and recycled materials also provide eco-friendly alternatives. Cork, a renewable material, is biodegradable and offers natural cushioning, while recycled materials, such as post-consumer recycled plastics, recycled rubber, recycled polypropylene (PP), and recycled high-density polyethylene (HDPE), help reduce waste and lower the environmental impact of production. On the other hand, some materials used for the insert substrate, such as ethylene-vinyl acetate (EVA) foam, polyurethane (PU) foam, latex foam, neoprene, memory foam, and thermoplastic elastomer (TPE) foam, are synthetic and are chosen for their durability, comfort, and performance in high-stress environments.

The adhesive on the top surface of the insert is designed to enhance adhesion to the shoe sole and assist in removing dust or debris from the sole. To achieve this, the adhesive could be made from biodegradable materials such as PLA-based adhesives, PHA-based adhesives, starch-based adhesives, cellulose-based adhesives, or natural rubber-based adhesives. These adhesives are chosen for their strong adhesive properties, which help capture dust and dirt from the shoe sole while also being biodegradable, thus minimizing their environmental impact.

The combination of biodegradable substrates and adhesives supports a reduction in the environmental footprint, as both components can decompose naturally or be recycled at the end of the product's lifecycle. By using recycled materials, plant-based options, and biodegradable components, the shoe guard minimizes waste and promotes more sustainable disposal practices, aligning with environmentally conscious design principles.

While certain embodiments depict the guard body as a comprehensive flexible overshoe structure, the underlying 'support structure' may adopt alternative forms. It could be realized as a minimalist frame or peripheral structure sufficient to hold the insert (120) in operational alignment with the shoe sole, potentially reducing weight and material usage. The essential function is providing a stable platform for the removable 'sole-contacting treatment element' (the insert) and shielding at least critical portions of the outsole.

The removable insert 120 itself, considered broadly as this 'sole-contacting treatment element,' offers potential for multi-functionality beyond adhesive cleaning. For instance, it might incorporate integrated micro-bristle regions for mechanical scrubbing or potentially carry/deliver conditioning agents. The mechanism for particle removal, primarily described as an adhesive layer, could be achieved through alternative 'tacky surfaces' or 'particle-attracting layers,' such as micro-suction arrays or electrostatically active materials. The 'releasable coupling mechanism' between the guard body 110 and insert 120 can be generalized beyond specific fasteners to any system establishing a sufficient retention force differential compared to the insert-to-shoe interaction force.

The modularity of the insert 120 facilitates customization. Kits could provide inserts optimized for specific debris types, cushioning levels, or surface textures. Advanced inserts might feature integrated wear sensors or simple electronic components like LEDs for visibility, potentially powered kinetically or via small batteries. Furthermore, methods for regenerating reusable adhesive surfaces beyond washing could include specialized wiping tools, chemical reactivation treatments, or specific mechanical actions tailored to the adhesive chemistry.

The utility of the shoe guard assembly extends beyond athletic footwear on indoor courts. Adaptations could allow use with work boots, dress shoes, casual footwear, or even sandals in diverse environments like cleanrooms, medical facilities, food preparation areas, industrial settings, construction sites, and general household use, potentially involving minor modifications to materials or design.

Finally, the shoe guard assembly may be provided as part of a kit. Such kits could bundle one or more guard bodies 110, a plurality of inserts 120 with varied properties, protective films (126), potentially specialized cleaning/reactivation supplies, and/or a travel case for storage and transport.

In typical use, a method 500 for treating the sole of a shoe 200 involves utilizing the shoe guard assembly 100. In step 510, the user first ensures the insert 120 is properly secured within the guard body 110 via the engagement of the insert fastener(s) on the insert bottom surface 122 to the guard body fastener(s) on the guard body top surface 112. In instances when a new insert is being secured in the guard body, in step 520, a protective film is already disposed on the new insert and so would have to be removed. In instances when a previously used insert is in use and the user wants to reuse the insert (because its adhesive is still sufficiently effective), there would be no need for step 520. In step 530, the user then positions their shoe 200 within the assembly such that the shoe sole makes contact with the adhesive present on the insert top surface 124 of the shoe guard. This contact allows dust, dirt, and other particulate matter to transfer from the shoe sole to the adhesive layer. Subsequently, when the user arrives at the venue (e.g., a basketball venue), in step 550, the user removes the shoe 200 from the shoe guard assembly 100. Due to the engineered force hierarchy, wherein the fastening force holding the insert 120 to the guard body 110 is greater than the adhesive force between the insert top surface 124 and the shoe sole, the insert 120 remains securely attached to the guard body 110 upon shoe removal. This action effectively cleans the shoe sole, leaving the captured debris on the adhesive surface of the insert.

The method may further include steps related to the protective function of the guard body 110. After positioning the shoe sole onto the insert's adhesive surface, in step 540, the user may secure the shoe guard assembly 100 to the shoe 200, for instance, by fastening straps over the shoe upper. The user can then walk while wearing the shoe 200 with the shoe guard assembly 100 attached. During this phase, the guard body 110, particularly its bottom surface 114, shields the shoe sole from abrasion and contamination from ground surfaces like pavement or concrete. This protective step typically precedes the final removal of the shoe 200 from the assembly just before athletic activity or entering a clean area.

For embodiments employing a reusable adhesive on the insert top surface 124, the method may also encompass maintenance steps. After the shoe 200 has been removed from the assembly, the user can optionally detach the insert 120 from the guard body 110 by overcoming the force of the cooperating fasteners. Once detached, the reusable adhesive on the insert top surface 124 can be cleaned, for example, by washing with mild soap and water or using specific cleaning wipes as described elsewhere herein, to restore its tackiness for subsequent use. Alternatively, the detached insert 120 can be replaced with a fresh or different insert. Following cleaning or use, a protective film 126 may be reapplied over the adhesive surface to preserve its cleanliness and tackiness during storage or transport.

In alternative embodiments, the insert may be designed for limited reuse, with a service life of one to five uses before replacement is recommended. This approach balances performance and hygiene by ensuring that the adhesive layer maintains optimal tack and debris capture efficiency without requiring washing or regeneration. In some embodiments, each insert may include a visual indicator—such as a color-changing ink or peel-away tab—to help users track usage cycles. The insert substrate and adhesive formulation are selected to retain functionality over the specified number of uses, after which the insert can be easily removed and replaced with a fresh unit. This model supports high-throughput environments, such as tournaments, where rapid turnover and consistent performance are prioritized over long-term reusability.

In other parts of this specification, a universal shoe guard is disclosed that is designed to accommodate shoes with slightly different contours or dimensional variances. This universal shoe guard uses a flexible and adaptable guard body that can fit a range of shoe models while maintaining a secure fit. The guard body is designed to be versatile, providing a functional solution for different shoe sizes and shapes. However, a method is also disclosed herein for further enhancing the fit by customizing the shoe guard for a specific shoe model.

In this embodiment, the method involves the use of a guard body piece that remains uniform for a given shoe size. Each guard body piece includes a recessed cavity designed to receive an elastomeric piece, which when assembled together forms a guard body. The guard body piece itself is essentially the same for shoes of the same size, with no variation in its overall shape or structure. The only difference between guard bodies of a certain size for different shoe models is the elastomeric piece, which is custom-printed based on the specific dimensions and contours of a particular shoe sole, as captured by a scanning process.

The scanning process creates a digital model of the shoe sole, which is used to generate a corresponding elastomeric piece that precisely conforms to the unique shape of the shoe. This elastomeric piece is then inserted into the guard body piece, where it fits securely into the cavity. The customization of the elastomeric piece allows the shoe guard to provide a tailored, precise fit for different shoe models, such as the Air Jordan 38™ or Under Armour Curry 7™, ensuring that the guard body performs optimally and enhances the overall fit and protection.

Once the elastomeric piece is generated, it is inserted into the recessed cavity of the guard body. The cavity is precisely molded to accommodate the elastomeric piece, ensuring a secure and stable fit. In some embodiments, the design of the cavity may include features such as ridges, grooves, or interlocking mechanisms to further secure the elastomeric piece in place and prevent any movement or slippage during use. These features ensure that the elastomeric piece remains securely attached to the guard body even under high-stress conditions.

In some embodiments, the elastomeric piece is bonded to the guard body using a suitable adhesive. The adhesive may be chosen based on the materials of the elastomeric piece and the guard body, ensuring a strong and durable bond that will withstand repeated use. In alternative embodiments, other fastening methods, such as mechanical interlocks or snap-fit designs, may be used to secure the elastomeric piece to the guard body. These methods provide flexibility in manufacturing and ensure that the customization process remains efficient and cost-effective.

In additional embodiments, the elastomeric piece is created using 3D printing technology, such as selective laser sintering (SLS) or fused deposition modeling (FDM). This allows for precise control over the material properties and dimensions of the elastomeric piece, ensuring an exact fit to the shoe sole. The material used for the elastomeric piece may include thermoplastic elastomers (TPE), silicone, or other suitable materials that provide flexibility, durability, and comfort. The 3D printing process enables the efficient production of custom shoe guards for different shoe models, ensuring that each guard meets the specific requirements of the shoe it is designed for.

Finally, the finished shoe guard, with its customized elastomeric piece securely in place, undergoes a quality control process to ensure it meets the required performance specifications. This includes testing the fit, stability, and durability of the shoe guard to confirm that it provides optimal protection and performance for the wearer. After passing quality control, the custom shoe guards are ready for use and can be distributed for various shoe models, providing a tailored solution for individual shoes.

Figure 10:
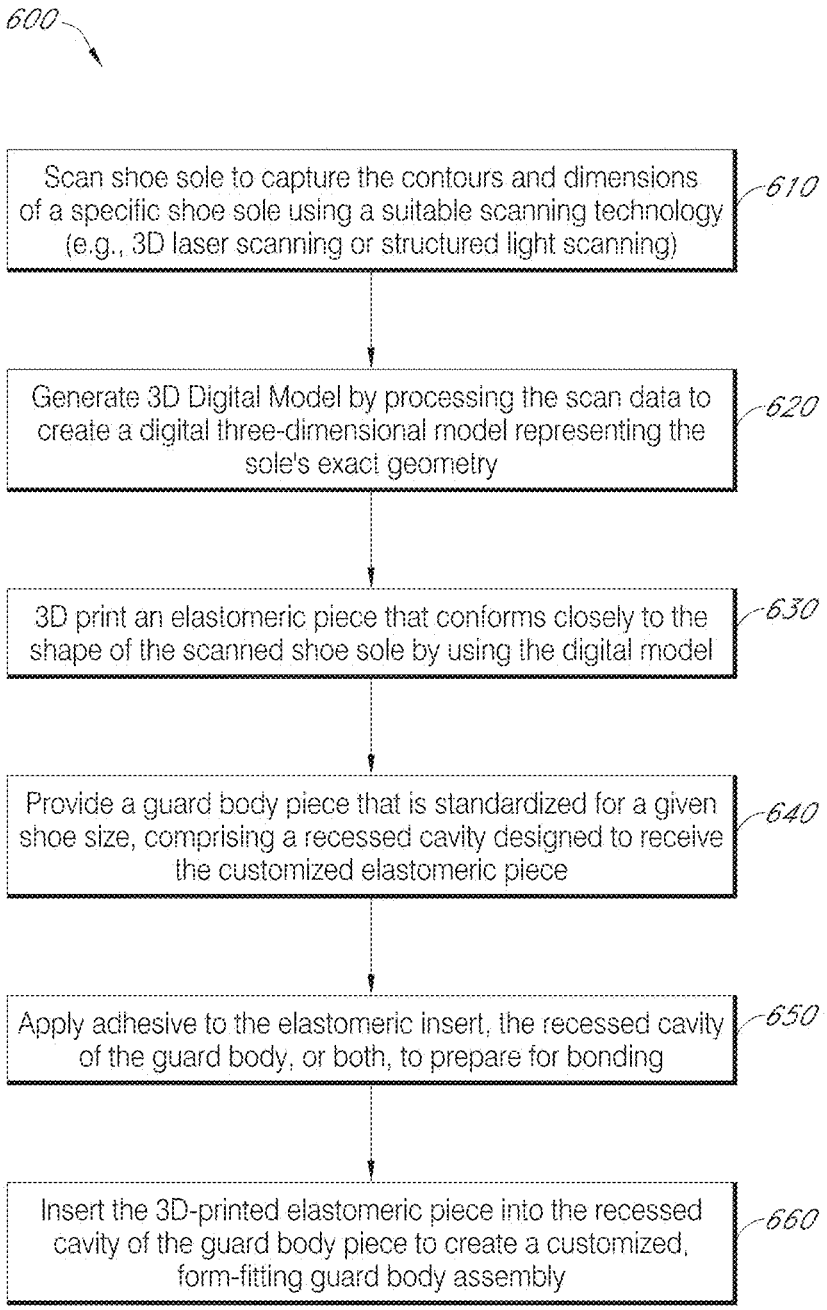
FIG. 10 is a flowchart illustrating an exemplary method for manufacturing a customized shoe guard.

FIG. 10 illustrates an exemplary method (600) for manufacturing a customized shoe guard designed to accommodate the unique contours and dimensions of a specific shoe sole. The method begins at step 610, wherein the shoe sole is scanned using suitable scanning technology, such as 3D laser scanning or structured light scanning, to capture precise dimensional and contour data of the shoe sole. This scanning process generates detailed information that reflects the unique geometry of the shoe's outsole.

At step 620, the raw scan data is processed to generate a three-dimensional digital model of the shoe sole. This digital model accurately represents the exact shape and contours captured in the scanning step, forming the basis for the subsequent customization of the shoe guard.

Step 630 involves using the digital model to 3D print an elastomeric piece tailored to conform closely to the contours of the scanned shoe sole. The elastomeric material selected provides the desired flexibility and fit, enabling the resulting piece to accommodate subtle variations in shoe size and shape.

In step 640, a guard body piece is provided. This guard body piece is standardized for a particular shoe size and includes a recessed cavity specifically designed to receive the customized elastomeric piece. The use of a standardized guard body piece with a recessed cavity allows for efficient manufacturing while enabling a high degree of customization via the elastomeric piece.

Step 650 comprises the application of an adhesive to either the elastomeric piece, the recessed cavity of the guard body piece, or both. This adhesive prepares the components for secure bonding, ensuring the customized elastomeric piece remains firmly attached to the guard body.

Finally, at step 660, the 3D-printed elastomeric piece is inserted into the recessed cavity of the guard body piece. This creates a customized, form-fitting guard body assembly that precisely matches the contours and dimensions of the specific shoe sole scanned in step 610, thereby providing a tailored fit that improves both comfort and performance.

In some embodiments, a shoe guard kit is provided comprising at least one shoe guard and a plurality of replaceable or disposable inserts. Each insert is configured to be removably secured within the guard body via a fastening mechanism, such as hook-and-loop fasteners, magnetic couplings, or snap-fit elements. The top surface of each insert includes a pressure-sensitive adhesive layer designed to remove dust, dirt, and particulate matter from the outsole of a shoe. The inserts may be individually packaged with protective films to preserve adhesive tack prior to use. This kit configuration is particularly suited for high-throughput environments such as athletic tournaments, training camps, or shared gym facilities, where users may prefer to discard and replace inserts after one or several uses rather than clean them. The kit may be offered in various sizes or adhesive tack levels to accommodate different sports, flooring conditions, or user preferences.

In other embodiments, the shoe guard kit includes a reusable insert and one or more cleaning materials for maintaining the adhesive surface of the insert. The reusable insert comprises a substrate with a washable adhesive layer, such as a silicone-based or hydrophilic acrylic adhesive, capable of regaining tack after cleaning. The kit may include a cleaning solution—for example, a mild detergent or alcohol-based spray—packaged in a small bottle, along with a cleaning cloth or brush designed to remove debris from the adhesive surface without damaging it. In some embodiments, the kit may also include a resealable storage pouch or protective film for preserving the adhesive between uses. This configuration supports sustainable use by reducing waste and extending the service life of the insert, making it ideal for individual athletes, environmentally conscious users, or institutional buyers seeking long-term cost efficiency.

These kit-based embodiments further illustrate the versatility and adaptability of the shoe guard system, offering users a range of options tailored to their performance, hygiene, and sustainability needs.

It will be appreciated that while specific implementations of the present disclosure have been described in detail, various modifications, enhancements, and adaptations may be made without departing from the spirit and scope of the present disclosure. Accordingly, the described embodiments should not be construed as limiting but rather as illustrative of the broader capabilities of the present disclosure.

It may be noted that the above-described examples of the present solution are for the purpose of illustration only. Although the solution has been described in conjunction with a specific embodiment thereof, numerous modifications may be possible without materially departing from the teachings and advantages of the subject matter described herein. Other substitutions, modifications, and changes may be made without departing from the spirit of the present solution. All the features disclosed in this specification (including any accompanying claims, abstract, and drawings), and all of the steps of any method or process so disclosed, may be combined in any combination, except combinations where at least some of such features or steps are mutually exclusive.

The terms "include," "have," and variations thereof, as used herein, have the same meaning as the term "comprise" or an appropriate variation thereof. Furthermore, the term "based on", as used herein, means "based at least in part on." Thus, a feature that is described as based on some stimulus can be based on the stimulus or a combination of stimuli including the stimulus.

The present description has been shown and described with reference to the foregoing examples. It is understood, however, that other forms, details, and examples can be made without departing from the spirit and scope of the present subject matter that is defined in the following claims.

What is claimed is:

1. A shoe guard assembly, the shoe guard assembly comprising:

a guard body comprising a top portion and a bottom portion, wherein the guard body is configured to cover an entire bottom surface of a sole of an athletic shoe, and wherein the guard body top portion comprises an upper surface and a lower surface, the upper surface and the lower surface together defining a recess in the top portion, wherein at least one guard body fastener is affixed in the recess; and an insert configured to be removably positioned in the recess in the guard body top portion, the insert comprising:

a substrate having a top surface and a bottom surface;

an adhesive layer disposed on the top surface of the substrate, the adhesive layer configured to removably adhere to the sole of the athletic shoe when the athletic shoe is placed on the guard body top portion to capture dust and debris therefrom, wherein the adhesive layer is configured to have an adhesive engagement strength when adhering the top surface of the insert to the sole of the athletic shoe;

at least one insert fastener affixed to the bottom surface of the substrate, the at least one insert fastener being configured to releasably engage with the at least one guard body fastener affixed in the recess of the guard body top portion with a mechanical engagement strength; and a removable protective film positioned over the adhesive layer to preserve tackiness prior to use;

wherein during use when the removable protective film is removed, the mechanical engagement strength that attaches the at least one insert fastener to the at least one guard body fastener exceeds the adhesive engagement strength that adheres the insert top surface to the sole of the athletic shoe such that the insert remains on the guard body with the captured dust and debris thereon when the athletic shoe is removed from the guard body; and wherein the top surface of the insert is substantially flush with the upper surface of the guard body top portion when the insert is positioned in the recess with the at least one insert fastener engaged with the at least one guard body fastener.

2. The shoe guard assembly of claim 1, wherein the adhesive layer comprises a pressure-sensitive adhesive that does not leave residue on the shoe sole.

3. The shoe guard assembly of claim 1, wherein the adhesive layer comprises a silicone-based adhesive.

4. The shoe guard assembly of claim 1, wherein the adhesive layer is water-resistant and retains tack after exposure to moisture.

5. The shoe guard assembly of claim 1, wherein the adhesive layer is reusable and configured to regain tackiness after cleaning.

6. The shoe guard assembly of claim 1, wherein the substrate is made from a material selected from the group consisting of ethylene-vinyl acetate (EVA) foam, polyurethane (PU) foam, latex foam, neoprene, memory foam, gel-based materials, and cork.

7. The shoe guard assembly of claim 1, wherein the substrate includes antimicrobial additives.

8. The shoe guard assembly of claim 1, wherein the adhesive engagement strength is in the range from approximately 200 gram-force (gf) to 1000 gf.

9. The shoe guard assembly of claim 1, wherein the insert fastener comprises a hook or loop field configured for engagement with a complementary loop or hook field on the guard body.

10. The shoe guard assembly of claim 1, wherein the insert fastener has a shear strength ranging from approximately 1000 gf to 10000 gf.

11. The shoe guard assembly of claim 1, wherein the protective film includes a pull tab to facilitate removal without contacting the adhesive surface.

12. The shoe guard assembly of claim 1, wherein the adhesive layer is zoned into regions of differing tack levels to target specific areas of the shoe sole.

13. The shoe guard assembly of claim 1, wherein the substrate includes a curved profile along its top surface to conform to a toe spring region of the shoe sole.

14. The shoe guard assembly of claim 1, wherein the insert fastener covers between 20% and 80% of the bottom surface of the substrate.

15. The shoe guard assembly of claim 1, wherein the insert top surface is configured to cover substantially the entire bottom surface of the sole of the athletic shoe.

16. The shoe guard assembly of claim 1, wherein the insert top surface is configured to cover the entire bottom surface of the sole of the athletic shoe.

17. The shoe guard assembly of claim 1, wherein the guard body comprises two opposed flaps that mate with each other over the vamp of the shoe.

* * * * *